US009211466B2

(12) United States Patent
Bell

(10) Patent No.: US 9,211,466 B2
(45) Date of Patent: Dec. 15, 2015

(54) PIVOTABLE BOOM GOLF SWING IMPROVEMENT DEVICE

(71) Applicant: John D. Bell, Morristown, TN (US)

(72) Inventor: John D. Bell, Morristown, TN (US)

( * ) Notice: Subject to any disclaimer, the term of this patent is extended or adjusted under 35 U.S.C. 154(b) by 0 days.

(21) Appl. No.: 14/689,004

(22) Filed: Apr. 16, 2015

(65) Prior Publication Data

US 2015/0265899 A1 Sep. 24, 2015

Related U.S. Application Data

(63) Continuation-in-part of application No. 14/316,320, filed on Jun. 26, 2014, now abandoned.

(60) Provisional application No. 61/839,378, filed on Jun. 26, 2013.

(51) Int. Cl.

| | |
|---|---|
| ***A63B 69/36*** | (2006.01) |
| ***A63B 69/00*** | (2006.01) |
| ***A63B 71/02*** | (2006.01) |

(52) U.S. Cl.

CPC ..... *A63B 69/3623* (2013.01); *A63B 69/0057* (2013.01); *A63B 71/023* (2013.01); *A63B 2210/50* (2013.01); *A63B 2220/801* (2013.01); *A63B 2225/093* (2013.01)

(58) Field of Classification Search

USPC ..... 473/215, 216, 274, 275, 257, 266, 268, 473/409

See application file for complete search history.

(56) References Cited

U.S. PATENT DOCUMENTS

| | | | |
|---|---|---|---|
| 1,238,492 | A | 8/1917 | Byrne |
| 1,604,118 | A | 10/1926 | Glancey |
| 1,636,753 | A | 7/1927 | Olcott |
| 1,936,143 | A | 11/1933 | Shea |
| 1,962,256 | A | 6/1934 | Nelson et al. |
| 2,252,831 | A | 8/1941 | Botts |
| 2,611,610 | A | 9/1952 | Hara |
| 2,626,151 | A | 1/1953 | Jenks |

(Continued)

FOREIGN PATENT DOCUMENTS

| | | |
|---|---|---|
| AU | 711213 | 11/1998 |
| GB | 312286 | 8/1930 |

(Continued)

*Primary Examiner* — Nini Legesse

(74) *Attorney, Agent, or Firm* — M. Alex Brown

(57) ABSTRACT

A golf swing practice and improvement device and system or process is disclosed for better training the golfing enthusiast to make straighter shots when hitting a golf ball, without hooking or slicing the ball. The device of the invention is provided with an adjustable boom assembly supported to provide three-dimensional positioning to a head guide subassembly attached to the boom assembly and used by the Golfer for proper stance and head position. The head guide is provided so that it can be placed from a frontal position at lateral or side portions of a golfer's head to guide and keep the head in position relative to the golf ball while the golfer is making their golf club swing to the golf ball. The boom assembly is made to be withdrawn frontally from the golfer's head just after the golfer makes contact in swinging their golf club with the ball. In so doing the golfer moves or trips a leg movement sensing switch of the invention providing power to a triggering assembly, when following through with the golf shot, thus providing an activating force or signal to move the head guide assembly away from the golfer's head, while permitting the golfer to make a natural follow-through with their swinging club after hitting the golf ball.

21 Claims, 17 Drawing Sheets

(56) References Cited

U.S. PATENT DOCUMENTS

| | | | | | |
|---|---|---|---|---|---|
| 2,690,911 | A | | 11/1954 | Newgren | |
| 3,104,880 | A | | 9/1963 | Profera | |
| 3,243,186 | A | | 3/1966 | Johnson | |
| 3,325,169 | A | | 6/1967 | Mackniesh | |
| 3,326,558 | A | | 6/1967 | Eaton | |
| 3,342,496 | A | | 9/1967 | Evans | |
| 3,350,102 | A | | 10/1967 | Tiernan | |
| 3,397,892 | A | | 8/1968 | Stahl | |
| 3,408,078 | A | | 10/1968 | Falerni | |
| 3,698,721 | A | | 10/1972 | Stewart | |
| 3,712,625 | A | | 1/1973 | Taylor | |
| 3,767,205 | A | | 10/1973 | Maldonado et al. | |
| 3,770,280 | A | | 11/1973 | Straus | |
| 3,880,431 | A | | 4/1975 | Swanson | |
| 4,302,014 | A | | 11/1981 | Shull | |
| 4,326,718 | A | | 4/1982 | Kiehl | |
| 4,513,972 | A | | 4/1985 | Empie | |
| 4,521,023 | A | | 6/1985 | Williams | |
| 4,659,084 | A | * | 4/1987 | Vuick | 473/264 |
| 4,998,731 | A | | 3/1991 | Bowen | |
| 5,039,105 | A | | 8/1991 | Ro | |
| 5,087,047 | A | | 2/1992 | McConnell | |
| 5,303,926 | A | | 4/1994 | Owens et al. | |
| 5,439,226 | A | * | 8/1995 | Luedtke | 473/232 |
| 5,577,729 | A | | 11/1996 | Sabour | |
| 5,586,761 | A | | 12/1996 | Brock et al. | |
| 5,634,858 | A | | 6/1997 | Bellagamba | |
| 5,895,363 | A | | 4/1999 | Preijde | |
| 6,343,998 | B1 | | 2/2002 | Tarulli et al. | |
| 6,402,633 | B1 | | 6/2002 | Hsiung et al. | |
| 6,843,730 | B1 | * | 1/2005 | Bellagamba | 473/216 |
| 7,204,766 | B1 | * | 4/2007 | Rose et al. | 473/274 |
| 7,275,998 | B1 | | 10/2007 | Jenkins | |
| 7,568,979 | B2 | * | 8/2009 | Arnold, Jr. | 473/258 |
| 7,572,192 | B1 | | 8/2009 | Boyd | |
| 7,666,106 | B1 | | 2/2010 | Hebert | |
| 8,133,127 | B1 | | 3/2012 | Synder | |
| 2006/0121999 | A1 | | 6/2006 | Bender | |
| 2009/0105006 | A1 | | 4/2009 | Doyle | |
| 2009/0118026 | A1 | * | 5/2009 | Arnold, Jr. | 473/211 |
| 2011/0275447 | A1 | | 11/2011 | Jasinski | |

FOREIGN PATENT DOCUMENTS

| | | |
|---|---|---|
| GB | 2424840 | 10/2006 |
| WO | 8002468 | 11/1980 |
| WO | 2004016328 | 2/2004 |
| WO | 2014198981 | 12/2014 |

* cited by examiner

PIVOTABLE BOOM GOLF SWING IMPROVEMENT DEVICE

CROSS-REFERENCE TO RELATED APPLICATIONS

This application claims the benefit of U.S. application Ser. No. 14/316,320, a non-provisional application filed on Jun. 26, 2014, and pending at the time of filing of this application, the disclosure of which is incorporated herein by reference, as if copied verbatim in its complete entirety. The '320 application claims the benefit of U.S. Provisional Application Ser. No. 61/839,378 filed Jun. 26, 2013, the disclosure of which is also incorporated herein by reference, as if copied verbatim in its complete entirety.

BACKGROUND OF THE INVENTION

1. Field of the Invention

The present invention relates to a boom and support device, and associated method and system for helping to improve the swing of a golfer.

2. Background Information

For over the last 100 years or more various devices have been made available to help to assist the golfer to improve their swing in the game of golf; and to thus prevent slicing, hooking or other imperfections in the golf swing which often led to inaccurate shots or shots that were not straight and able to place the golf ball at an intended target on the golf course. Many hundreds of inventions were presented all over the world, which in some way attempted to address this objective in making a person more capable of hitting a straight or more accurate golf shot.

As indicated, hundreds of such devices were invented around the world and made the subject of patentability. However, only a small number of these many inventions were able to make any contribution to utilizing the position of the golfer's head region to help to bring about a more proper golf shot, such that they held the golfer's head area in a stable but flexible position and released the golfer's head position only after the golf ball was stuck by the practicing golfer. The present invention thus meets an important need, in its structure and functional operation, to guide the position of the head more properly as one is making a shot such that a straight or more accurate golf swing and shot can be brought about through the use of the present device; and such that training and practicing on the present Golf Swing Improvement Device will result in more accurate and straight golf shots when one is not using the present device.

SUMMARY OF THE INVENTION

The foregoing and other objects of the invention can be achieved with the present invention's device and system. In one aspect, a generally electrical and mechanical device having a ground support and upwardly extending (in relation to a ground surface) vertical boom support member provided for positioning in relation to a desired outside or inside ground or floor surface. The vertical boom support is utilized to adjustably position the present invention's boom subsystem or subassembly so that it is three-dimensionally adjustable in positional relation to the lateral dimensional aspects of a person's head region, utilizing the present invention. The boom subsystem utilizes an outside surfacing and an internally joining, movable inside surfacing to effect pivotable movement of the boom subsystem. The inside surfacing is connected to a removable and adjustable head subassembly at one of its ends and a catch or trigger receipt portion at, or proximal to, it's other end. A biasable member is attached to the inside surfacing proximate to the head subassembly of the boom subassembly and extends to a securement portion on the outside surfacing of the boom subassembly; thus, providing biasing force between the inside surfacing and the outside surfacing. Thus, when the biasable member is extended and the boom subassembly is in cocked or in set position, triggering of the movable and pivotable inside surfacing causes the head portion to move or pivot toward the opposite end of the outside surfacing of the boom subassembly, away from the golfer's head position. In one aspect of the invention the outside surfacing supports a mechanical triggering mechanism for contact when the inside surfacing is so positioned with its trigger receipt portion to hold the inside surfacing in position for pivotable motion release of the inside surfacing. In another aspect of the invention an electrical solenoid or release means is secured on the outside surfacing on the boom, with an extendable arm or trigger which communicates with the trigger receipt portion of the internal surfacing, for cocking and release of the inside surfacing. The invention is provided in fully mechanical embodiments and fully electronic embodiments or in mixed mechanical and electrical or signal components for use by the practicing golfer. In one aspect and preferred embodiment of the invention, the mounting and triggering subassembly (mount/trigger) is provided in one unit which is attached to the outer surface of the boom subassembly. The mount/trigger is provided with a base support having the top side and the underside. The solenoid-switch means, in this case a switch solenoid, is mounted and supported on the top side of the base support. Extending from the switch solenoid, and extending through the base support, is the trigger-arm cable. The cable attaches to the trigger arm which is pivotably supported from the underside of the base support. The cable is also surrounded in preferred embodiments with a trigger arm biasing member which provides biasable pressure to push the trigger arm downward to an uncocked or untriggered position; thereby, requiring some amount of force to place the trigger arm in a cocked or triggered position. The outside surfacing of the boom assembly is provided with a channel or open column defined by the outer surfacing. The bottom portion of the trigger arm is biased to extend into the channel of the outside surfacing. The inside surfacing is provided with a trigger mount at its end portion. When the boom subassembly is placed in cocked or triggered position the lower portion of the trigger arm is brought into contact and positioned or latched behind the trigger mount or stop member, which holds the inner surfacing in cocked or ready position, thus overcoming the biasing force imposed between the inner surfacing and the outer surfacing, so that the head subassembly is in extended position and the lateral portions of the Golfer's head can be held in proper stance and position. At this time the head subassembly is positioned on lateral portions of the Golfer's head, positioning the head and eyes as they point downward and focus in on the golf ball for the golf shot.

In another aspect of the invention the golf club trip lever is engaged with an electrical switch which actuates the solenoid or electrical release means to release the extendable arm or trigger such that the inside surfacing pivots away from the users head taking with it the head subassembly, which had been positioned around lateral portions of the Golfer's head. Thus, through the employment of either aspect of the present invention the head subassembly comfortably holds the head in a proper position while one is making a golf swing such that the head subassembly is not released and withdrawn from the golfer's head portion until the golfer makes contact with the golf ball, and simultaneously or contemporaneously engages the golf club trip lever and switch; or, in other aspects and preferred embodiments, the leg sensing lever and switch; each acting as a switch to provide power or energy to the triggering subsystem or subassembly; and is in the process of completing follow-through on their golf shot. Other aspects of the present invention more comfortably facilitate the re-cocking or re-setting of the inner surfacing, within the outer surfacing, of the boom subassembly for re-use for another golf shot through mount and trigger subassembly or means.

Further aspects of the invention provide a non-rigidly positioned, safety head subassembly which will non-bindingly and adjustably position the user's head in a proper, but comfortable, position for making a proper swing; and which will comfortably remove itself from the user's head after the golf ball is struck by the golf club in a substantially non-frictional and non-abrasive manner.

In another aspect of the invention, a generally vertically positioned (through three-dimensional means) boom subassembly is provided with an outer enclosure which has a pivotally movable and installed inner enclosure. The inner enclosure and the outer enclosure are connected by a biasing means or subassembly which places biasing pressure to pull the inner enclosure, containing the head assembly, backward towards the further end of the outer enclosure. The outer enclosure has channeling at one of its ends having an elongated beginning and end. The inner enclosure is provided with a trigger mount or stop element proximal or proximate to one of its ends for movement inside and along the channeling, and a flexible and adjustable head subassembly is positioned at another of its ends. As indicated, the biasing means interacting with the outer and inner enclosures is installed to pull the inner enclosure so that the stop element of the inner enclosure is moved to the end of the channeling. A means for setting and releasing the inner enclosure in relation to the channeling is installed in proximal positional relation to the outer enclosure and the channeling, and is provided with the trigger element which registers with the channeling and receives the trigger mount or stop element of the inner enclosure when it is brought to a set or triggered position. The trigger is connected to an off-on actuator; and the actuator communicates with a leg-movement-activated switch supplied by a power means. When the leg presses against an extension of the switch, or switch extension, this causes the switch to move to an on-position where power is supplied to the off-on actuator causing it to pivot the trigger and release it from the stop element which causes the biased inner enclosure to pivot and move within the outer enclosure, drawing the head assembly away from lateral portions of the golfer head where the boom has been positioned prior to striking the golf ball.

It is an object of the present invention to fulfill a substantial need in the golf swing device technology in providing a reasonably light, easily transportable unit and system which can be set up and used easily by the practicing golf person; and which can be used by left and right hand golf club-swingers as well as tall or short persons (or children), in terms of where the pivotal boom and switch extension are, each, three-dimensionally positioned by virtue of these elements being adjustable, to suit the individual dimensions of the golfer.

It is a further object of the invention to provide a golf practicing device and system which enables its head subassembly to easily and comfortably fit around lateral areas of a person's head region, for comfortable and releasable guidance when the golfer is practicing their swing, and to provide the head subassembly, so that it can be easily adjusted to achieve this positional purpose in relation to each individual Golfer. In this regard it is also an objective to provide a golf-swing guidance head subassembly which is removed from around lateral areas of a golfer's head region as soon as the golfer makes contact with the golf ball, and contemporaneously, or at about the same time, moves their forward or foremost leg against the leg extension and activation switch, during their swing, such that golf swing follow-through is not impeded.

It is yet a further object of the present invention to provide a golf-swing practice device which is very easy and user-friendly to reset or reload or re-cock for time-efficient reuse of the present PIVOTABLE BOOM GOLF SWING IMPROVEMENT DEVICE and system.

BRIEF DESCRIPTION OF THE DRAWINGS

FIG. 3 is shown in the untriggered or uncocked position and FIG. 4 is shown in a cocked or triggered position.

REFERENCE NUMERALS USED IN THE APPLICATION

Figure 1:
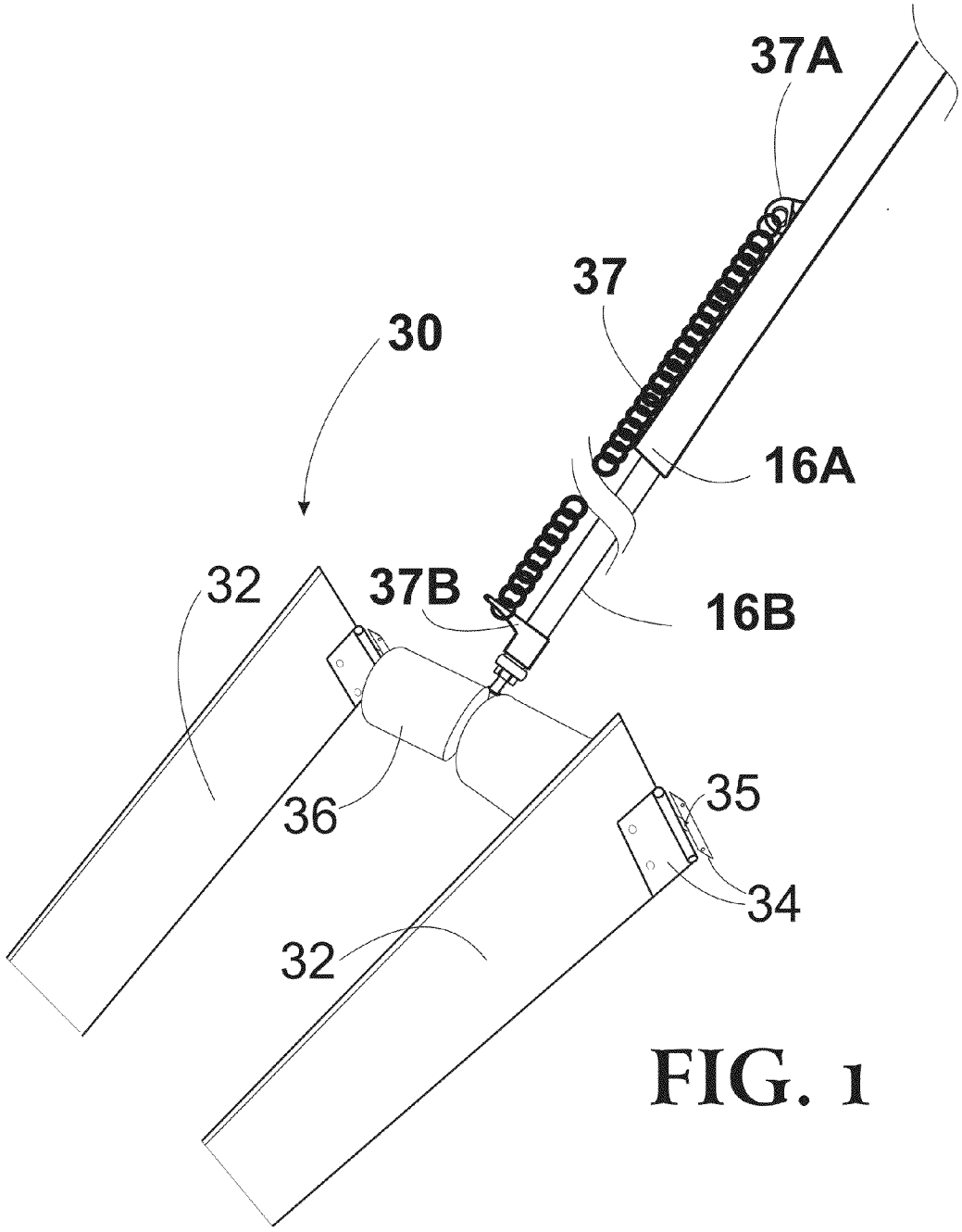
FIG. 1 is a partial fragmentary elevated side perspective view of a preferred embodiment of the boom subassembly of the present invention.
Figure 2:
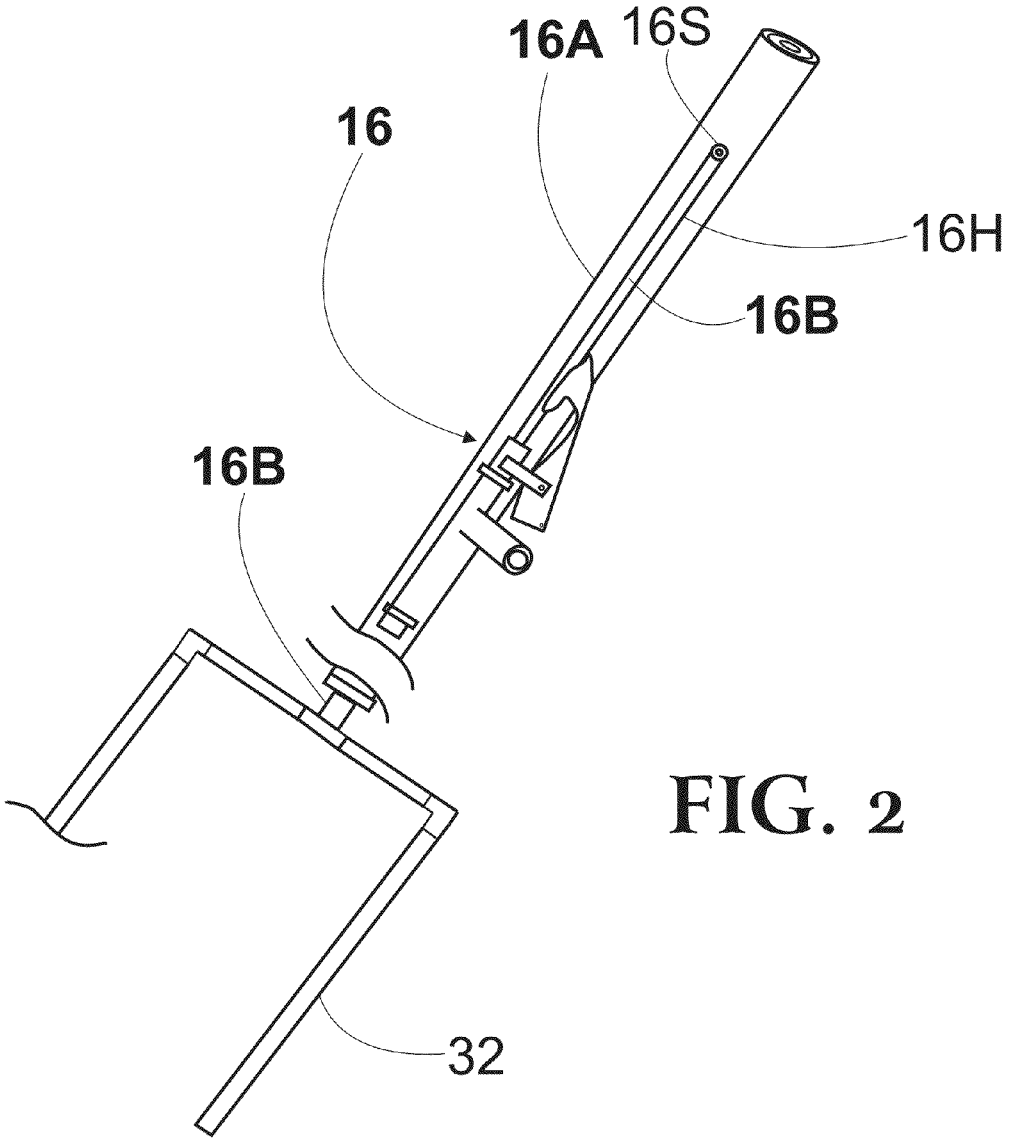
FIG. 2 shows a perspective view of the lower portion of the boom subassembly of the present invention.

1 golf ball
2 practicing golfer or golfers (or Golfer's)
5 golf club
10 the present invention, the PIVOTABLE BOOM GOLF SWING IMPROVEMENT DEVICE, or invention's device or system; or Golf Device or system
12 support base subassembly
12A center lateral support member of (12)
14A middle portion 14A of (12A)
14A' internal support member
14B elbow portion of (12A)
14C elbow portion of (12A)
12B lateral extension of (12)
12C lateral extension of (12)
15 vertical upright support member
15A securement collar of vertical support member (15)
15B center support member of (15)
15C extension member of (15).
16 boom subassembly
16A outside support member, enclosure or surfacing
16B pivotable or slideable inside guide member, enclosure or surfacing
16F forward portion of boom subassembly (16)
16H the hole, groove, reception area or guidance-movement channel or channeling provided on and in the outside guide member (16A)
16H-1 beginning segment or portion of (16H)
16H-2 end segment or portion of (16H)
16S stop-member or stop point means of (16B),
17 safety and security plug of the inner surfacing (16B)
18 mount/trigger subassembly or means, solenoid or like means
18A trigger-rocker arm or trigger
18B base plate of (18)
18F rocker arm pivot frame or means
18S solenoid or pivot switch means (as shown by examples in FIGS. 2 through 9), or off-on actuator
19 side shelf or flange of base plate (18B)
19A u-bolt member or means of attachment
19B u-bolt member or means of attachment
19C solenoid strap or band means
18SC extension cable of solenoid (18S)
19S solenoid support post on flange (19)
19CC covering of cable (18SC)
21 electrical wiring, in a preferred embodiment, placing the mount/trigger subassembly or means (18) on parallel or equivalent circuit with the switch or switches (183 and/or 185) and the power means (175P)
24 vertical support reception member or means of (18B)
24A securement bolt or means of (24)
24B Inner chamber of reception member (24)
30 head guiding subassembly of boom subassembly of (16)
32 lateral side walls
34 hinge members or means of the lateral side walls (32) of the head guiding subassembly (30)
35 cross connection member or means
36 padded members or means of the head guiding subassembly (30)
37 biasing means, subassembly or member
37A securement member or means of outside surfacing (16A)
37B securement member or means of inside surfacing (16B)
50 cross base subassembly (additional preferred embodiment)
52A longitudinal and elongated base member of (50)
52B crossing base member of (50)
52B' pivotable attaching member of (50)
54B adjustment member or members of (54A)
55 pivotable and movable hinge member of (54A)
56 adjustable wheels and axels
140A collar support of boom support (FIG. 14)
140B adjustment member of collar support (FIG. 14)
175A electrical wiring placing the power source or means (175P) on parallel circuit or equivalent circuit with the switch or switches (183 and/or 185) and the mount/trigger subassembly or means (18)
175B electrical wiring, in a preferred embodiment, placing the switch 183 on parallel or equivalent circuit with the power means (175P) and the mount/trigger subassembly or means (18)
175C electrical wiring, in a preferred embodiment, placing the switch 185 on parallel or equivalent circuit with the power means (175P) and the mount/trigger subassembly or means (18)
175P power source or means, or energy or power means
180 leg sensing subassembly
182 first extension leg contact member of leg subassembly (180) for right-handed Golfer, or extension
183 switch or biasable switch means connected to first extension member (182)
184 second extension leg contact member of leg subassembly (180) for right-handed Golfer, or extension
185 switch or biasable switch means connected to second extension member (184)
186 mounting adjustment support bar of subassembly (180)
188 leg sensing base support of (180)
189 vertical extension of (188)
190 extension prong of base (188) or extension support prong
192 clamp member portion of extension prong (190)
193 clamp position base of extension prong (190)
193A, 193B securement members or means of securing the clamp position base (193) to the clamp member portion (192)

194 securement collar portion of extension prong (190)

195 tightening bolt or such means for securement of collar portion (194)

DETAILED DESCRIPTION OF PREFERRED EMBODIMENTS OF THE INVENTION

The following description of the preferred embodiments of the concepts and teachings of the present invention is made in reference to the accompanying drawing figures which constitute illustrated examples of the teachings, and structural and functional elements, of the present invention's device and system; among many other examples existing within the scope and spirit of the present invention.

Referring now to the exemplar drawing illustrations, FIGS. 1 through 14, thereof, there are illustrated preferred embodiments of the present invention, the PIVOTABLE BOOM GOLF SWING IMPROVEMENT DEVICE and the invention's device or system or method, Golf Device, or the Invention, 10.

As shown in FIGS. 1 through 7, 9, 11, 12 and 14; the boom subassembly 16 is provided with the outside support member or surfacing 16A and the pivotable or slideable inside guide member or surfacing 16B. The outside surfacing 16A and the inside surfacing 16B are dimensioned so that the internal surfacing 16B can easily slide and pivot within the internal dimensioning of the outside surfacing 16A. The outside surfacing 16A is further provided with, and defines, the hole, groove, reception area or guidance-movement channel 16H such that the inside surfacing can be viewed. The inside surfacing 16B is provided with the stop-member or stop point means 16S which is discussed later herein along with the channel 16H.

Figure 3:
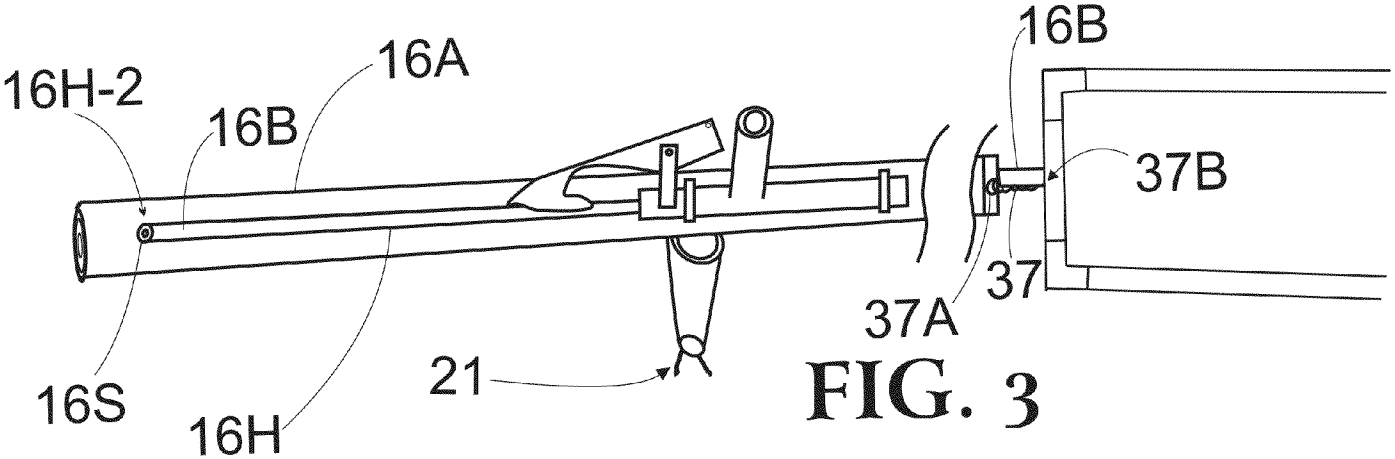
FIGS. 3 and 4 are, respectively, lower and upper fragmentary. perspective views of portions of preferred embodiments of the boom subassembly of the invention.
Figure 4:
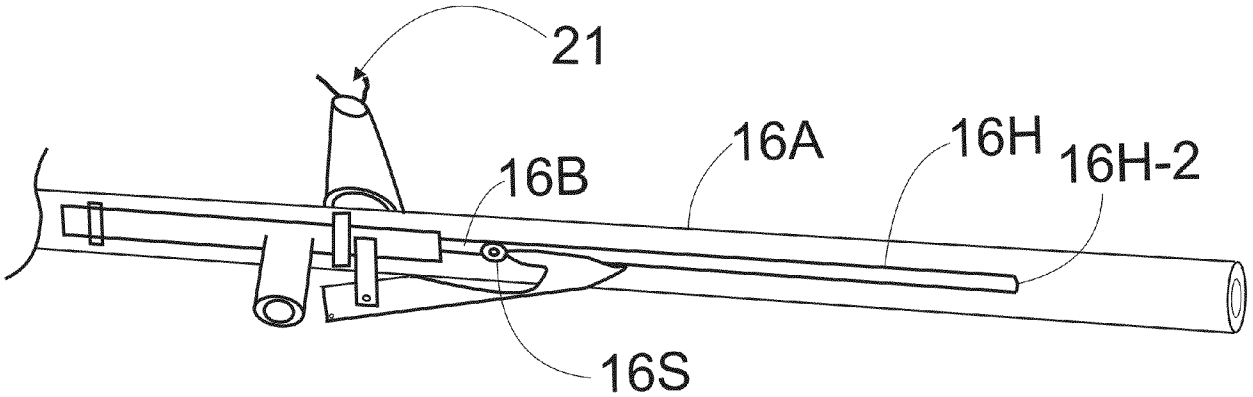
Figure 5:
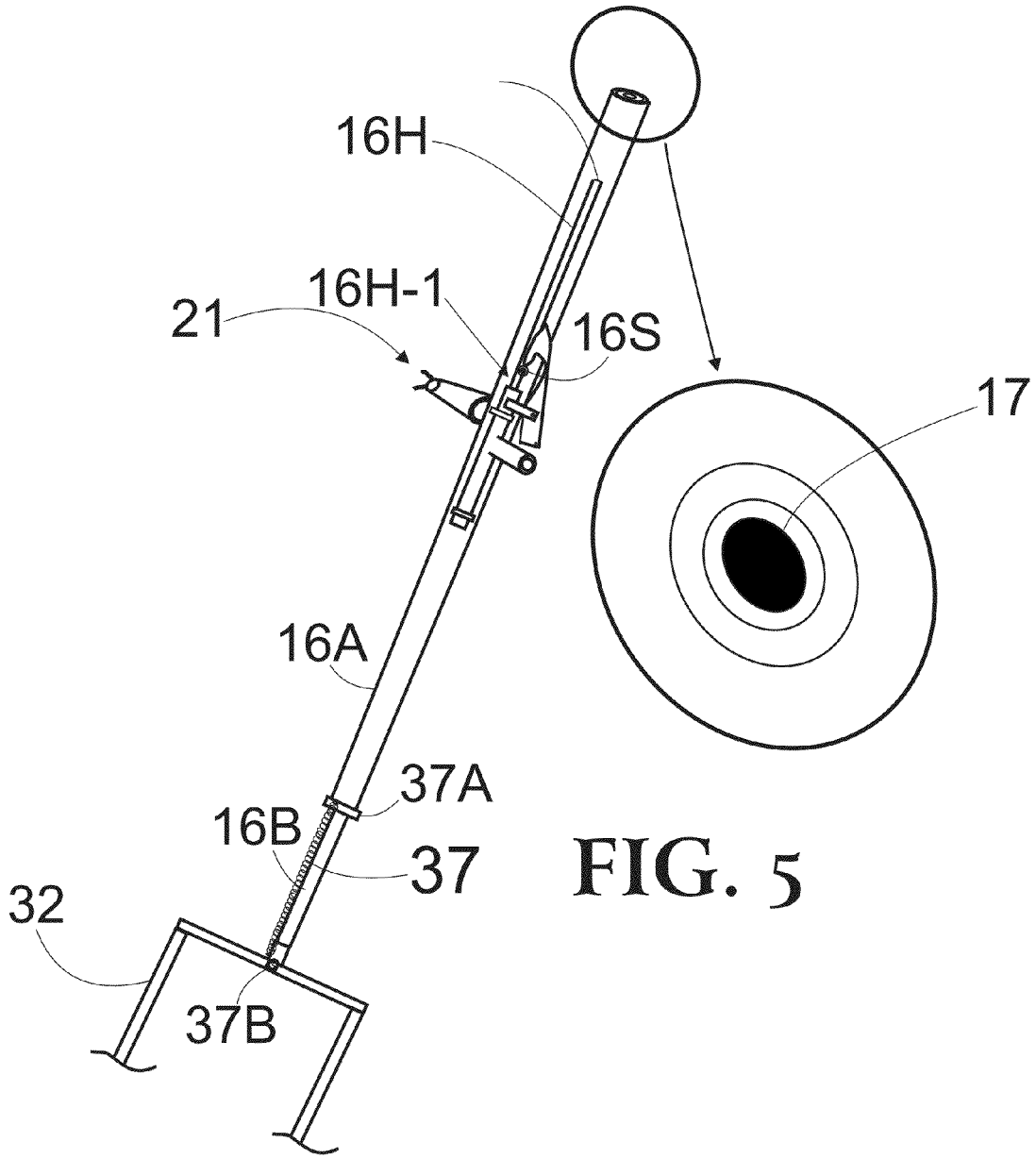
FIG. 5 is a side perspective view of a the boom subassembly of the embodiment of FIGS. 3 and 4, showing an enlargement of an end portion of the boom subassembly.
Figure 6:
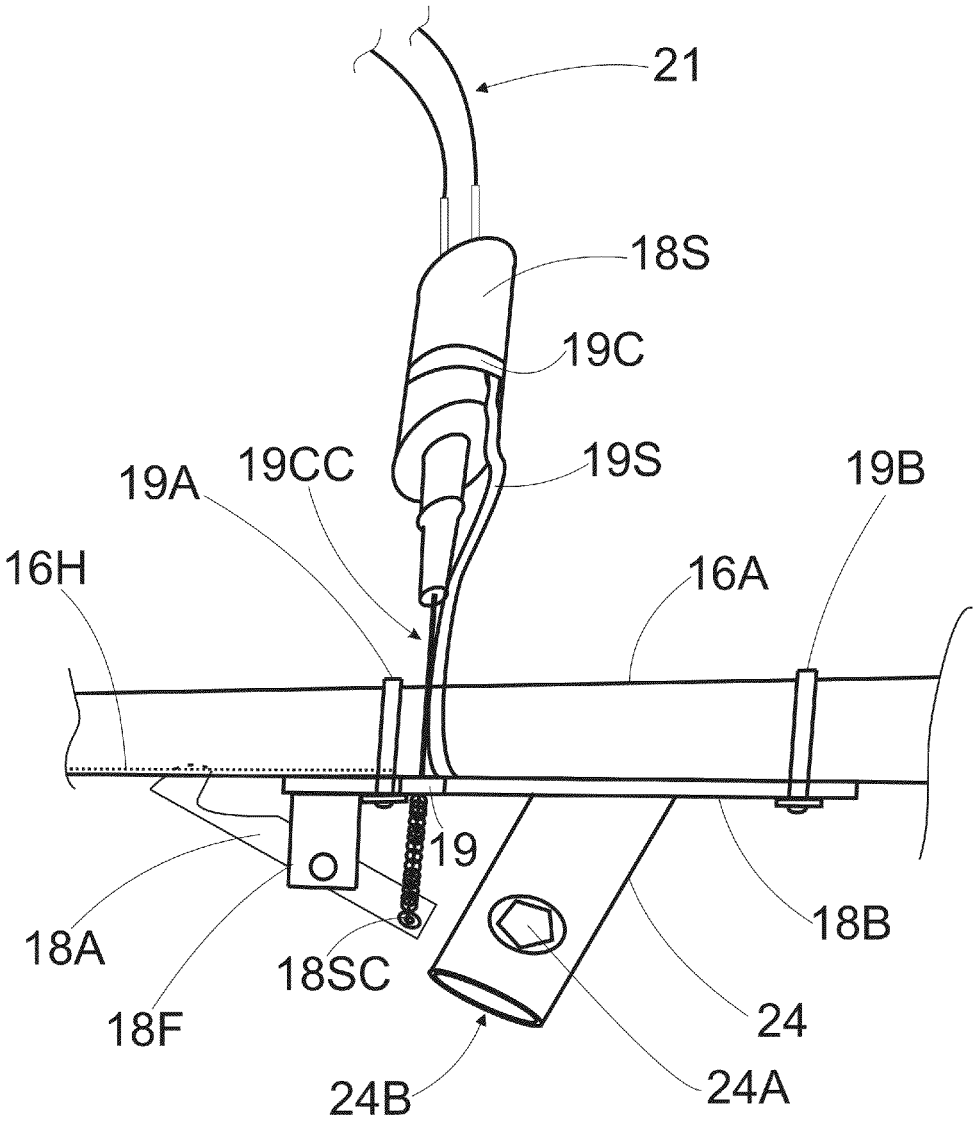
FIG. 6 is a fragmentary side perspective view of the triggering and mount portion of the boom subassembly showing the triggering portion of the invention in uncocked or untriggered position.
Figure 7:
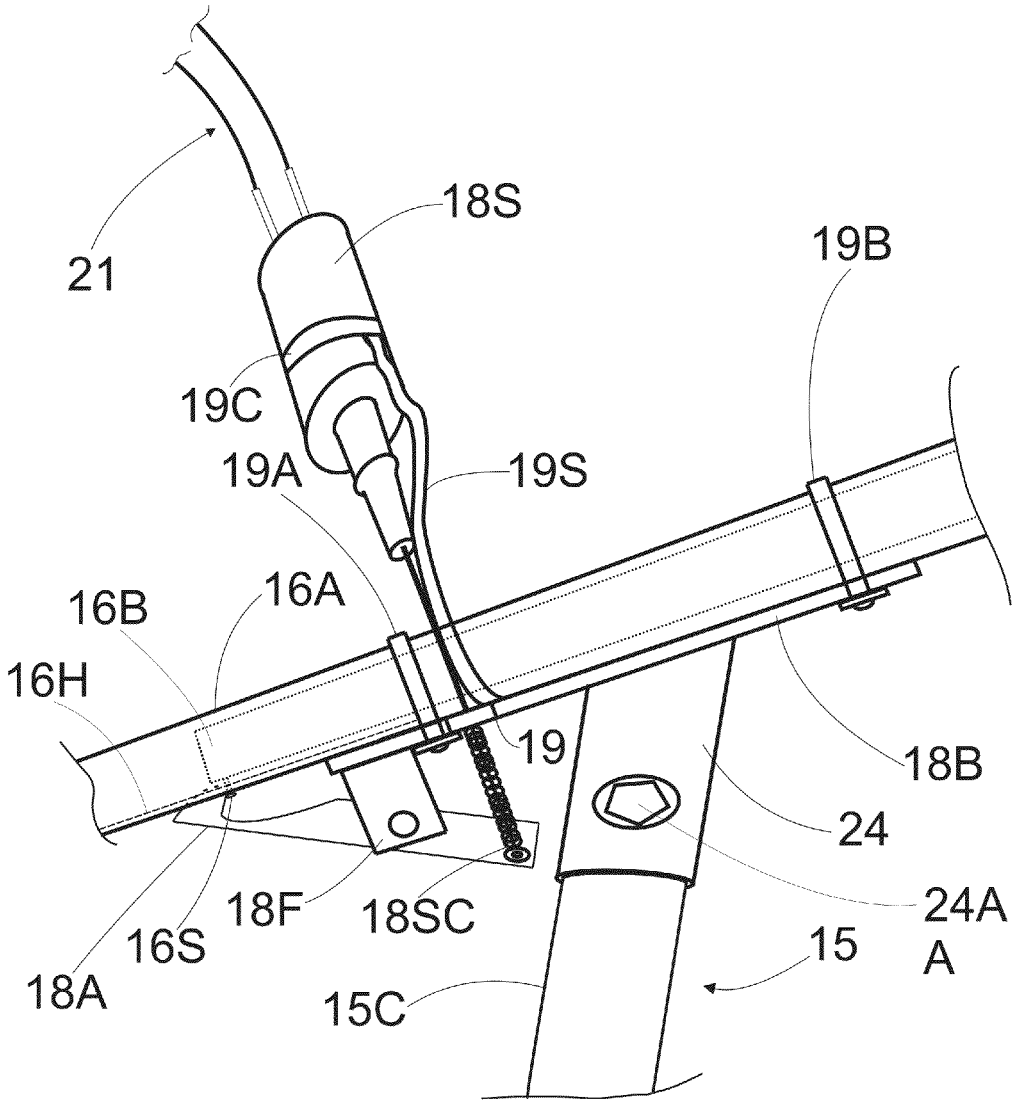
FIG. 7 is a fragmentary side perspective view of the triggering and mount portion of the boom subassembly showing the triggering portion of the invention in cocked or triggered position, ready to pivot and remove the headpiece subassembly from the golfer's head as the golfer strikes the golf ball, engages the leg switch subassembly and follows through with their swing.
Figure 8:
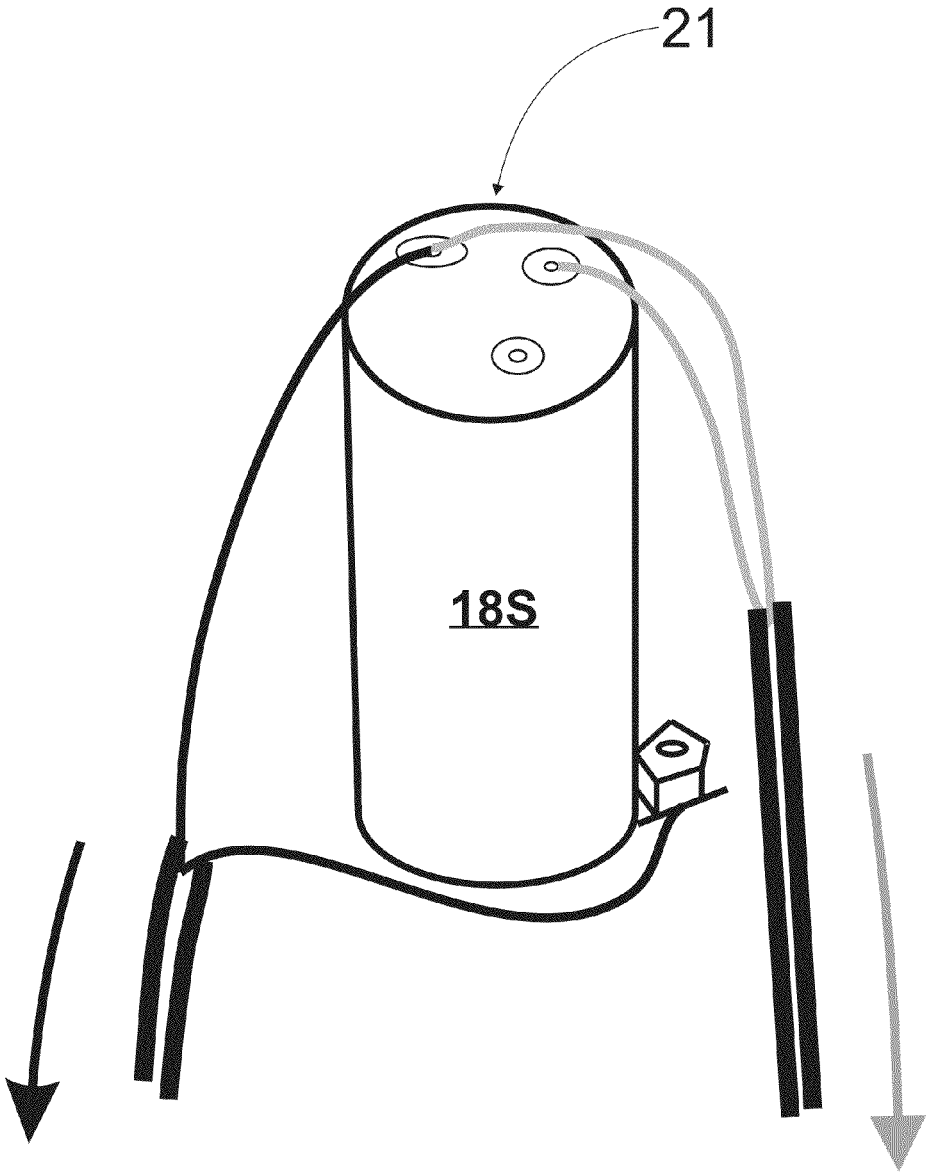
FIG. 8 shows an illustrative example of a solenoid-type pivoting element used in the present invention with another preferred wiring.
Figure 9:
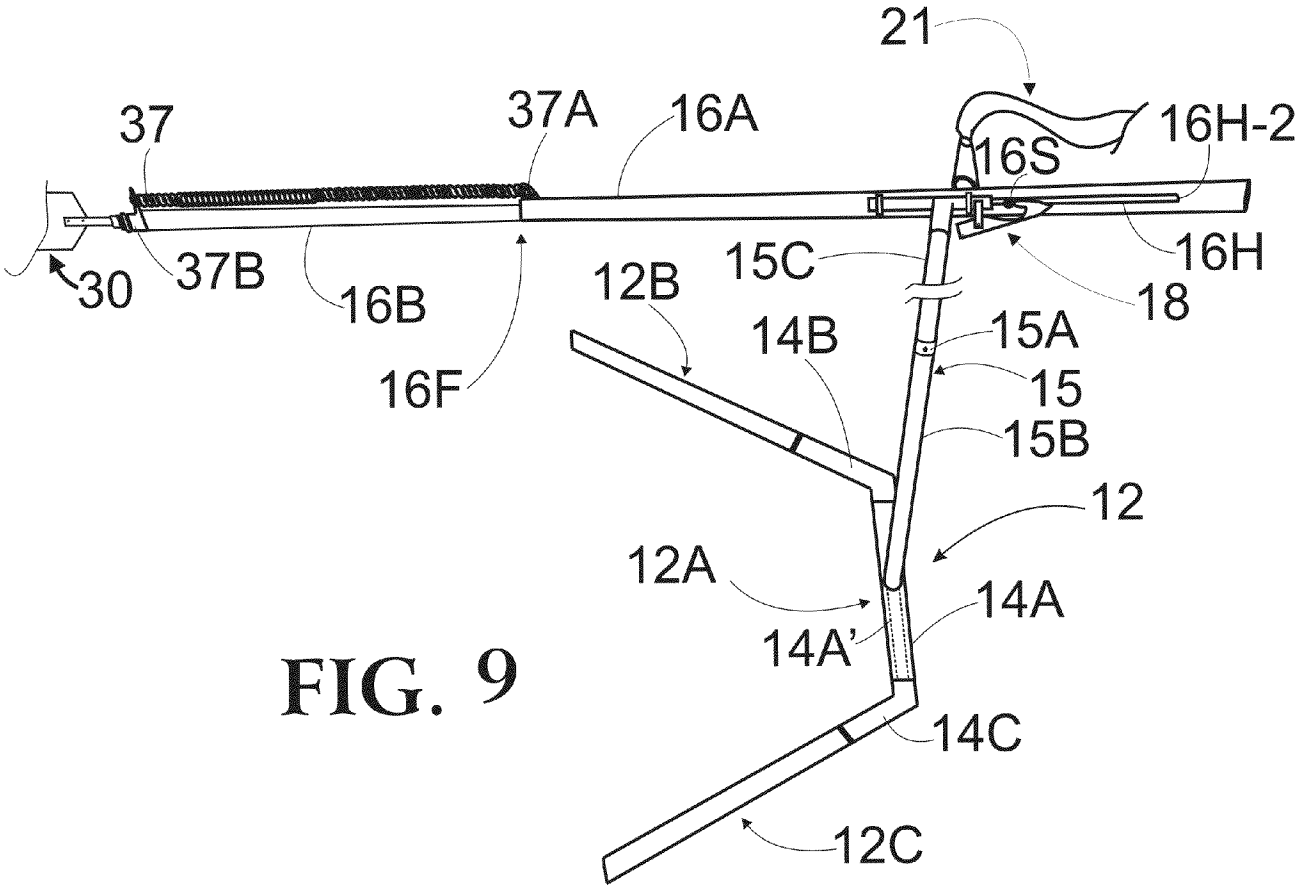
FIG. 9 is a perspective view of the present invention showing a complete view of the boom assembly of the invention, with the exception of showing a fragmentary view of one of the headpiece assemblies of one of the preferred embodiments of the invention. The leg sensing subassembly is not shown in this drawing illustration.
Figure 9A:
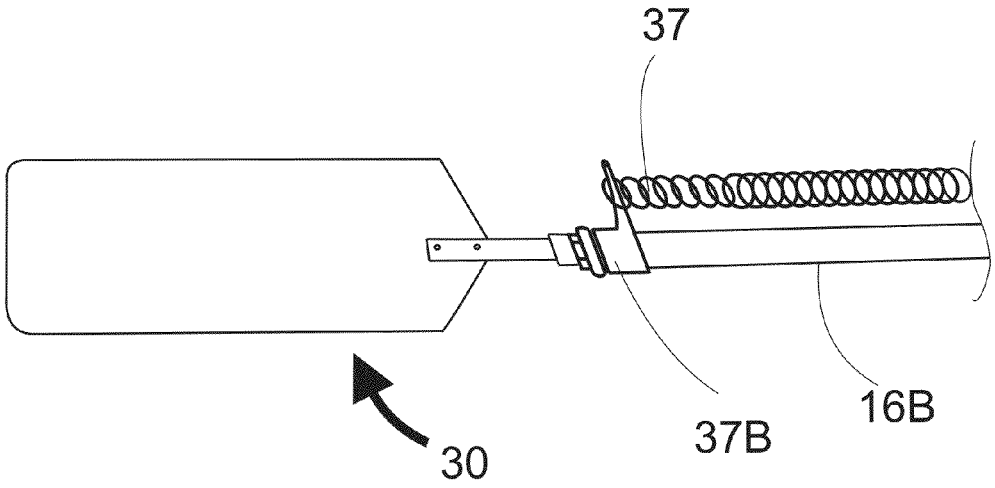
FIG. 9A is an enlarged side view of the end portion of the head subassembly and boom subassembly of the invention of FIG. 9.

The biasing means or member 37 is attached at one of its ends on the inside surfacing 16B, on securement member 37B, and at another of its ends is attached on the outside surfacing 16A, on securement member 37A, as illustrated by example in FIGS. 3, 5 and 9.

The surfacing's 16A and 16B can be fabricated or constructed, as indicated in earlier applications made a part and incorporated within this application and referenced herein, above; of plastics, polymers, metals and other durable materials. Examples, without limitation, include pvc-tubing materials, aluminum and light metal materials; or graphite and a host of other light durable materials, and flexible and durable materials and composites thereof.

The Invention 10 is provided with the support-base subassembly 12. This subassembly 12 is provided with a number of base-support members for convenient construction and light deployment and transportation of the invention. The center lateral support member 12A is provided with the middle portion 14A and elbow portions 14B and 14C, all of which can be provided in preferred embodiments in one-piece construction (including all these portions connected in one-piece construction); but the center member 12A can also be provided in these multiple parts, or further multiple parts. In preferred embodiments the middle portion 14A of the support 12A is provided with an internal support member 14A' which spans the internal length of the middle portion 14A. Please note in FIG. 9 that the internal support is shown by example in the first half of the middle portion 14A, rather than its entire length for illustrative purposes.

The first lateral extension 12B is connected to one of the elbow portions 14B or 14C; and the second lateral extension 12C is connected to the other of the elbow portions 14B or 14C of the center lateral member 12A.

The vertical upright support member 15 is provided and installed in connection with the middle portion 14A so that it extends positionally, and generally vertically, for connection with the boom subassembly 16 discussed herein. However, the support member 15 can also, in preferred embodiments, be provided in a generally perpendicular or transverse positional orientation in relation to the center lateral support member 12A or the angle of the floor or ground, or other area upon which the support-base subassembly 12 is supported.

Figure 9B:
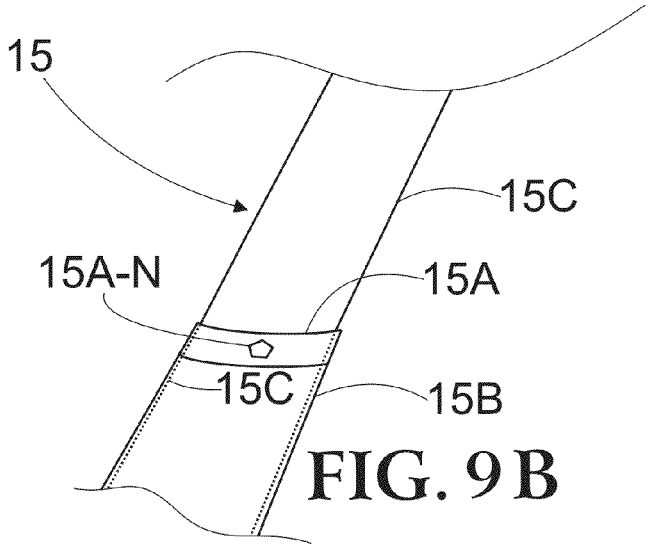
FIG. 9B shows an enlarged portion of the area adjoining the securement collar (15A) of the vertical upright support (15)

Preferably, in preferred embodiments, the vertical upright support member 15 is provided as a telescoped member having the securement collar 15A, the center support member 15B and the extension member 15C; as shown by example in FIGS. 9 and 9B. Within the scope and spirit of the invention 10, this means of three-dimensional and vertical positional placement of the support member 15 can be affected such that the member 15 can be positioned in various different positional orientations so that the boom subassembly can be positionally adopted to serve the height and stature of most all practicing Golfers 2.

The invention 10 is further provided in preferred embodiments with the mount-trigger subassembly 18, as shown by examples thereof in FIGS. 2 through 7, and 9. The mount-trigger 18 is provided with a base plate 18B, and the mount/trigger 18 is attached by the base plate 18B to the outside surfacing 16A. The base 18B can be attached in a number of ways. For example, in FIGS. 6 and 7, the subassembly 18 is attached by its base 18B to the outside surfacing 16A by u-bolt members 19A and 19B. However, it will be appreciated, within the scope and spirit of the invention, that the base 18B can be attached to the outside surfacing 16A through a number of sturdy or rigid, fixed and secure means.

The mount-trigger 18 is further provided with the rocker arm pivot frame or means 18F, which houses the trigger-rocker arm 18A for movement within, and away from, the guidance-movement channel, as illustrated by example in FIGS. 2, 3, 4, 5 and 9. In so doing, the pivot frame 18F is installed on an end portion, as illustrated by example, of the base plate 18B. As previously indicated, the pivot frame housing 18F and its rocker arm 18A will be installed in such a positional manner that the end portion of the rocker arm 18A will extend within the guidance-movement channel 16H, for engagement and release of the stop-member or stop point means 16S of the inside surfacing 16B as discussed herein.

The base plate 18B of the mount-trigger 18 is further provided with the solenoid or pivot switch means 18S, as shown by examples in FIGS. 2 through 9. The base 18B is provided with the side shelf or flange 19; and the flange 19 is utilized to rigidly connect with and support the solenoid support post 19S. The solenoid 18S is, thus, supported on the base plate 18B by the support post 19S, as shown by example in FIGS. 6 and 7. The solenoid means 18S is supported by the solenoid strap or band means 19C on the support post 19S, as shown by example; but it can be supported on the post 19S by a number of rigid and fixed means, to support the solenoid 18 on the base plate; and, of course, as indicated, various different means can be utilized to support the base plate 18B on the outside surfacing 16A. The solenoid is provided with the extension cable 18SC. The cable 18SC extends downwardly from the solenoid 18S and extends through a hole or port in the flange 19, and connects with an end portion of the trigger-rocker arm 18A. Above the flange 19 of the base plate 18B the cable 18SC is characteristically encircled with a protective cable cover 19CC; but it will be understood that a solenoid or power switch means can be utilized in the present invention 10 which is provided with different cable structure and/or protective coverings or sheathing for its cable, wiring or structure; or other structurally different components; which, when energized, cause a piece or other element to pivot or move, and to function within the present invention as discussed herein.

The base plate 18B is further provided with the vertical support reception member or means 24, as a rigidly fixed member of the base plate 18B. As illustrated, by example, in FIGS. 6 and 7 the reception member is attached to a bottom portion of the plate 18B at a generally diagonal angle to the base plate 18B. It may also be attached so that the reception member 24 extends in a generally transverse angle, or can be provided as an angle-adjustable member. In preferred embodiments, as illustrated by example, the reception member 24 is provided with the securement bolt or means 24A for securing the vertical upright support member 15 when the inner chamber 24B receives for installment the extension member 15C of the vertical upright support member 15.

The various elements discussed in the several paragraphs above can be positioned and installed in relation to the boom subassembly (16) and the position these elements face with regard to the installation surface of the Boom Subassembly utilized for practicing golf shots in a number of preferred positional ways, so that the groove or reception area 16H and the mount/trigger subassembly or means and their associated elements are positioned to face towards the installation surface or away from the installation surface in various angles less than. more than or equal to a relative transverse or 90 degree angle. This is done by their positioning on the outside surfacing 16A of the boom subassembly 16, and the relative corresponding positioning of the stop member 16S on the inner surfacing 16B. This is illustrated, by examples only, in FIGS. 2 through 7, and 9

In a preferred embodiment of the invention 10 the head guiding subassembly 30 is provided with lateral side walls 32, as illustrated in FIG. 1.

Each of the lateral side walls 32 is provided with the hinged member or means 34, which is connected to the cross connection member or means 35. In so doing the walls 32 are mounted positionally opposite one another and can pivot to provide lateral spacing and fitting to the sides of a golfer's head. The subassembly 30 is further provided with padded members or means 36 for comfort and fitting of a golfer's head when the invention is in use; and the subassembly is attached to the end portion of the inner guide member or surfacing 16B, as illustrated in FIG. 1. The head subassembly 30 can be attached within the meaning and scope of the invention 10 in a number of ways including, by example without limitation, bolting, welding and/or soldering means, and/or glue or polymer means. Preferably the subassembly 30 is positioned and attached at an end portion of the inside guide member 16B so that it can be pivoted, rotated or moved for better fitting on the lateral sides of a Golfer's head position when the invention 10 is in use.

The inside guide member or surfacing 16B is thus fitted so that the stop-member 16S, mounted and attached to the inside surfacing 16B can move along guidance-movement channel 16H of the outside surfacing 16A until it comes to a stop at the end of the channel 16H. The outer surfacing 16A is also provided with the safety and security plug 17, as illustrated by example in FIG. 5.

As indicated herein, the biasing means or member 37 is utilized to provide a magnitude of force which pulls an extended inside guide member or surfacing 16B with the attached head subassembly 30 back away from the Golfer's lateral head portion and toward the rear portion of the outside support member or surfacing 16A such that the stop-member 16S comes to stop, or ceases movement at the end portion of the guidance-movement channel 16H. When the invention is set, triggered or re-triggered for use, previous to movement and cessation of movement, as discussed just above, the trigger-rocker arm 18A is activated to move by the solenoid or pivot switch means 18S, when activated itself, causing the trigger-rocker arm 18A to disengage from the stop member 16S, upon which it has been set, and the stop member moving with the inner surfacing 16B to be pulled back to the end portion of the guidance channel 16H, thus pulling the head subassembly 30 back away from a Golfer's head. In this regard, the solenoid means 18S, as illustrated by example in preferred embodiments of the invention shown in FIGS. 2 through 9, works in communication with the leg sensing subassembly 180.

Figure 10A:
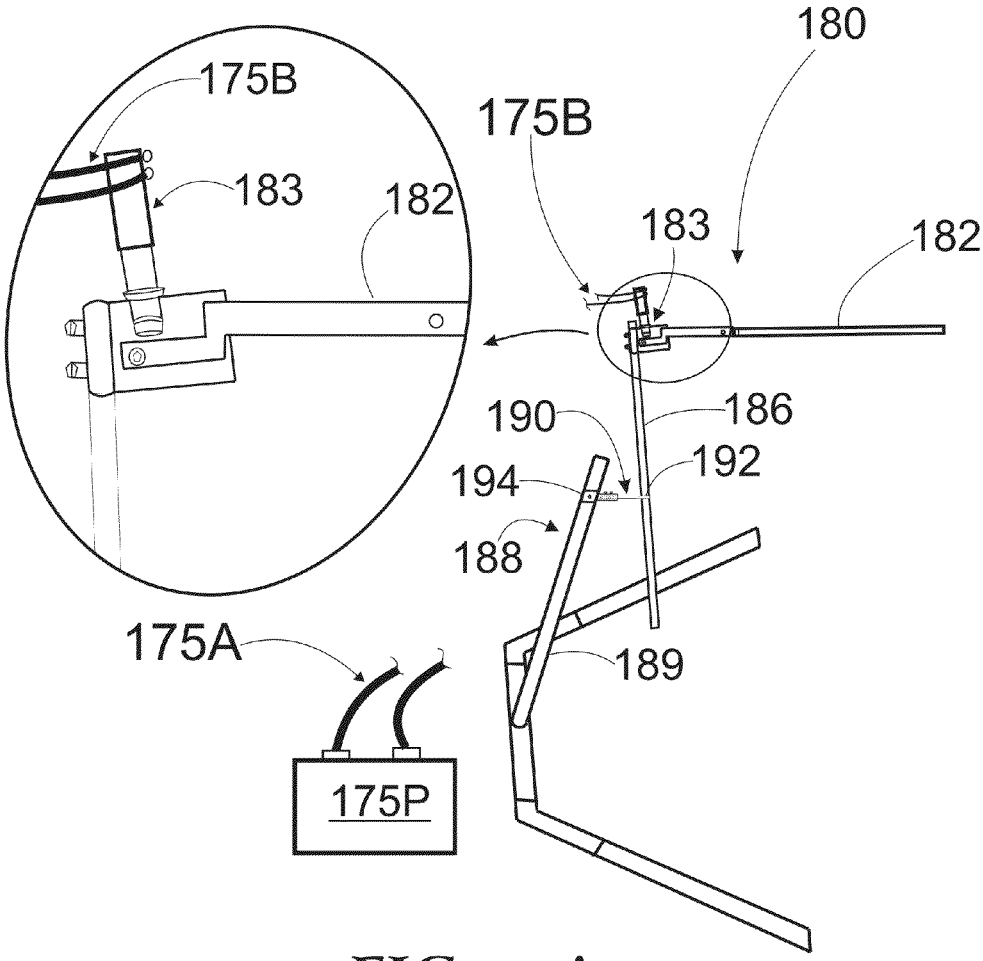
FIG. 10A is a perspective view of a preferred embodiment of the thigh or leg extension activating switch subassembly of the present invention, with an enlargement being shown of the switch element of the subassembly. This present preferred embodiment is positioned for use by a right-handed golfer and can be adjusted and placed on the other side of its support element for use by a left-handed golfer.
Figure 10B:
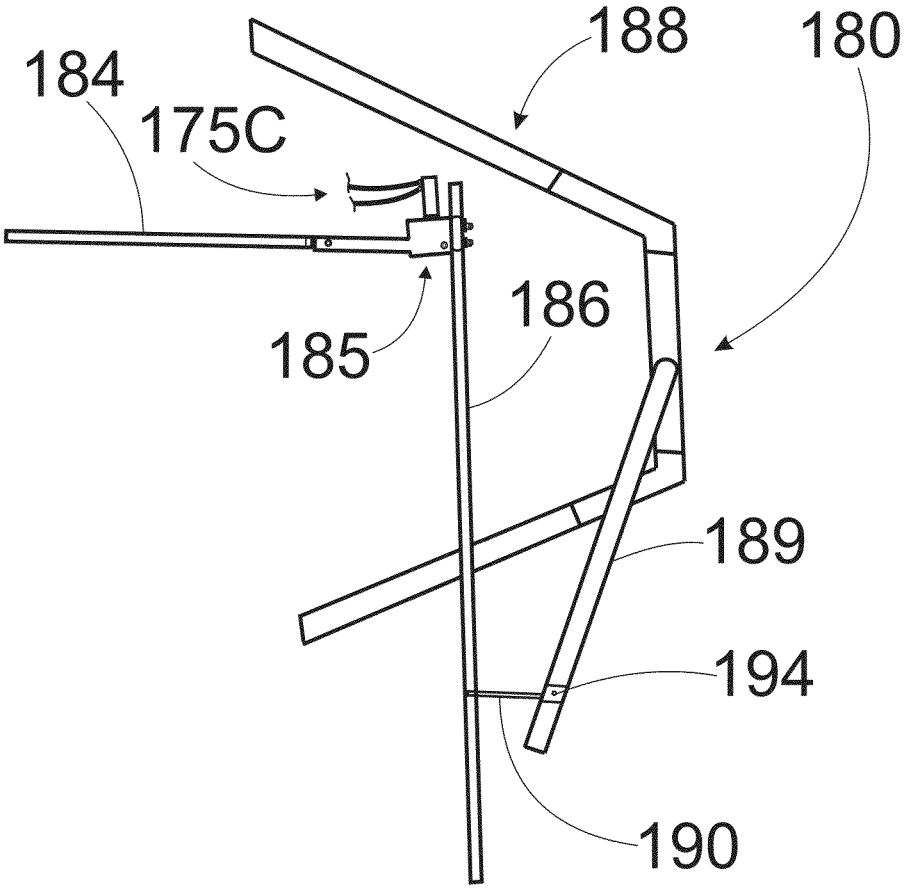
FIG. 10B is a perspective view of a preferred embodiment of the thigh or leg extension activating switch subassembly of the present invention, positioned for use by a left-handed golfer.
Figure 10C:
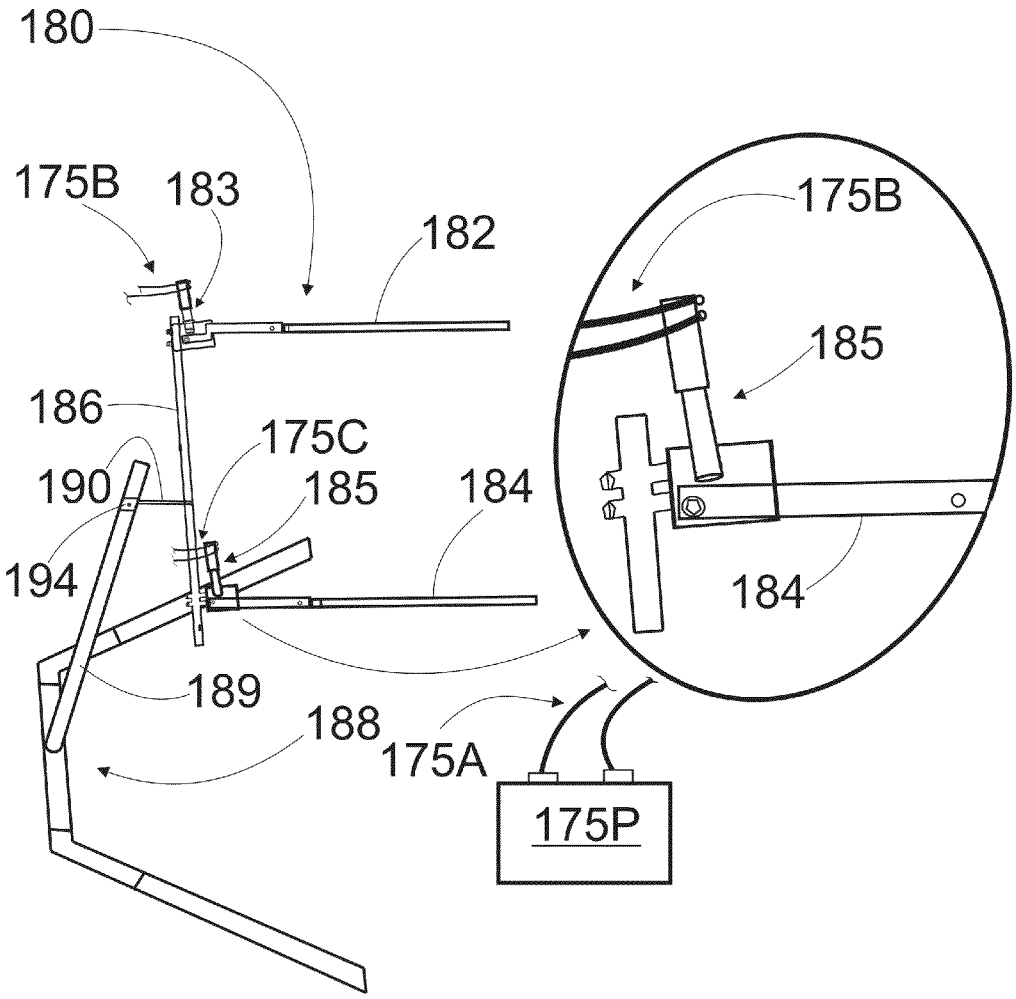
FIG. 10C is a perspective view of the leg extension subassembly, illustrating the preferred setup, by example, when both leg and thigh extension switch and extension members are used or deployed at the same time, or when this subassembly or subsystem of the present invention is used where or when both left-handed and right-handed Golfers will be present using the present invention.
Figure 10D:
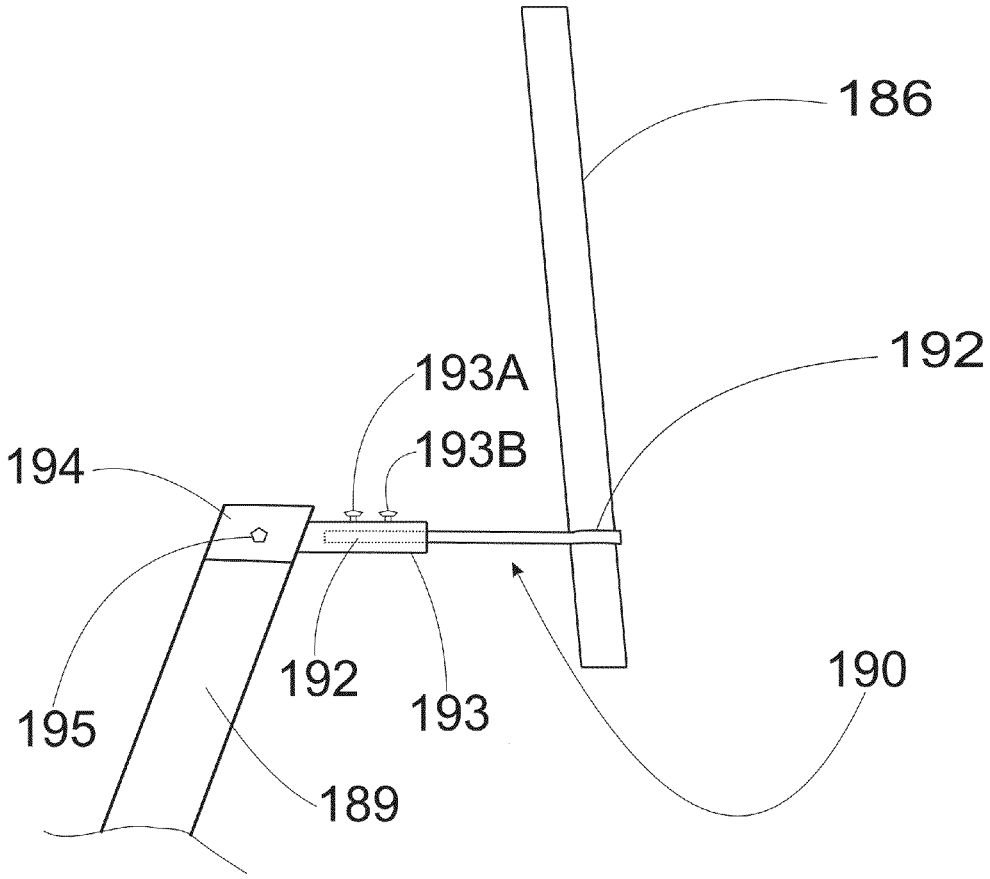
FIG. 10D is an enlarged partial side view showing aspects of the extension prong (190) of the vertical extension (189) of the leg sensing base support (188) of the present invention.

The sensing subassembly 180, as illustrated by example in FIGS. 10A, 10B, 10C, and 11, is provided with a first extension leg contact member 182 and a second extension leg contact member 184, each of which can be attached and supported separately, as illustrated in FIGS. 10A and 10B (by virtue, respectively, of right-handed use and left hand use embodiments); or together, as illustrated in FIG. 10C. When the golfer follows through with their swing forward, that person's foremost or front (facing the direction where one is hitting the ball) leg, thigh, or knee area will engage, when used, the right-handed extension leg contact members 182; or, when used, the left-handed extension leg contact member 184. This, then, further engages a switch member or means 182S or 184S, to which each respective extension leg contact is connected, which then provides or activates power, through the connected power source or means 175P, communicating it to the solenoid or pivot switch means 18S.

The leg sensing subassembly 180 is further provided with the mounting adjustment support bar 186 upon which the switch 183 and the connected first extension leg contact 182 are attached, and the respective switch 185 and connected second extension leg contact (when used) are attached. The respective switches and connected extension leg contact members can be adjusted along the mounting adjustment support bar 186 for ideal positioning by virtue of screw/bolt or other securement means provided as support for the respective switches on the mounting adjustment support bar 186. In turn, the mounting adjustment support member 186 is supported for functional use by the leg sensing base support 188. The leg sensing base 188 is provided with similar structural features and fabrication, construction components in a manner as described herein with regard to the support base subassembly 12. In addition, the base 188 is provided with the extension prong 190 to support the mounting adjustment support bar 186 for extended three-dimensional support of the switch means and extension members (182, 183, 184, and 185), as discussed herein and illustrated by example in FIGS. 10A, 10B, 10C and 10D. In so doing, in preferred embodiments, the extension prong 190 is provided with a clamp member portion 192 which holds the mounting bar 186. The clamp member portion 192, itself, is held and supported by the clamp position base portion 193. This clamp position base portion 193 is provided with securement members or means 193A and 193B which can tighten or loosen the position of the clamp member portion 192 so that the mounting bar 186 can be moved and adjusted to a desired position before the securement members of the clamp base (193A and/or 193B) are tightened to securely fix the position of the clamp and the mounting bar which it holds. The extension prong 190 is further provided with the securement collar portion 194 which is connected integrally or through separate connected part or member (as other portions herein) to the clamp position base portion (193). In preferred embodiments the securement collar portion 194 is provided as a circular collar with its own tightening bolt or such means 195 for securing the securement collar 194 to the vertical extension 189 or other section or portion of the base 188; as illustrated by example in FIGS. 10A, 10B, and 10C; and further in FIG. 10D. Thus, the extension prong 190 is facilitated through the members and means just described for adjustably positioning and securing the prong 190 and the mounting bar 186, based on their functional ability to provide three-dimensional positional adjustment capability and means to the elements of the leg sensing subassembly 180.

Figure 11:
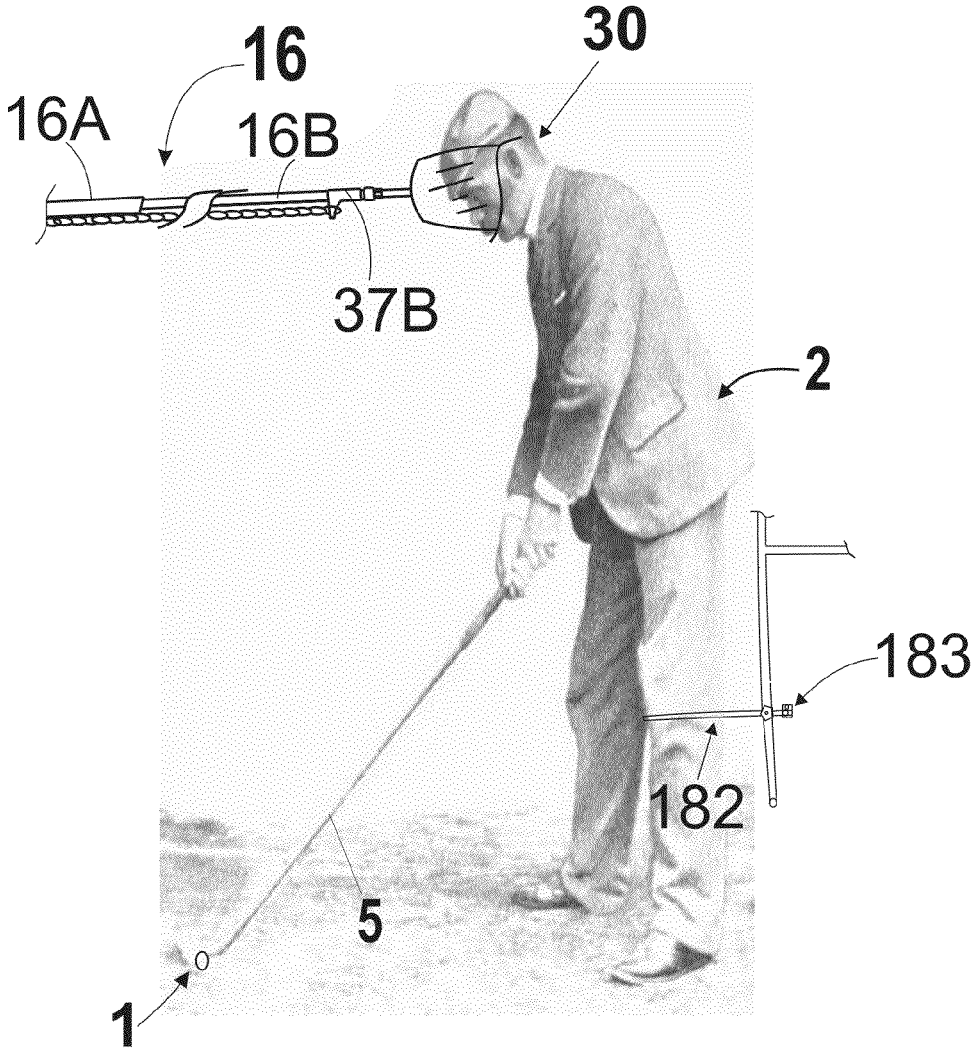
FIG. 11 shows an illustrative right-handed golfer with fragmentary views of the thigh or leg extension activating switch subassembly and the boom subassembly of the present invention in functional position.
Figure 12:
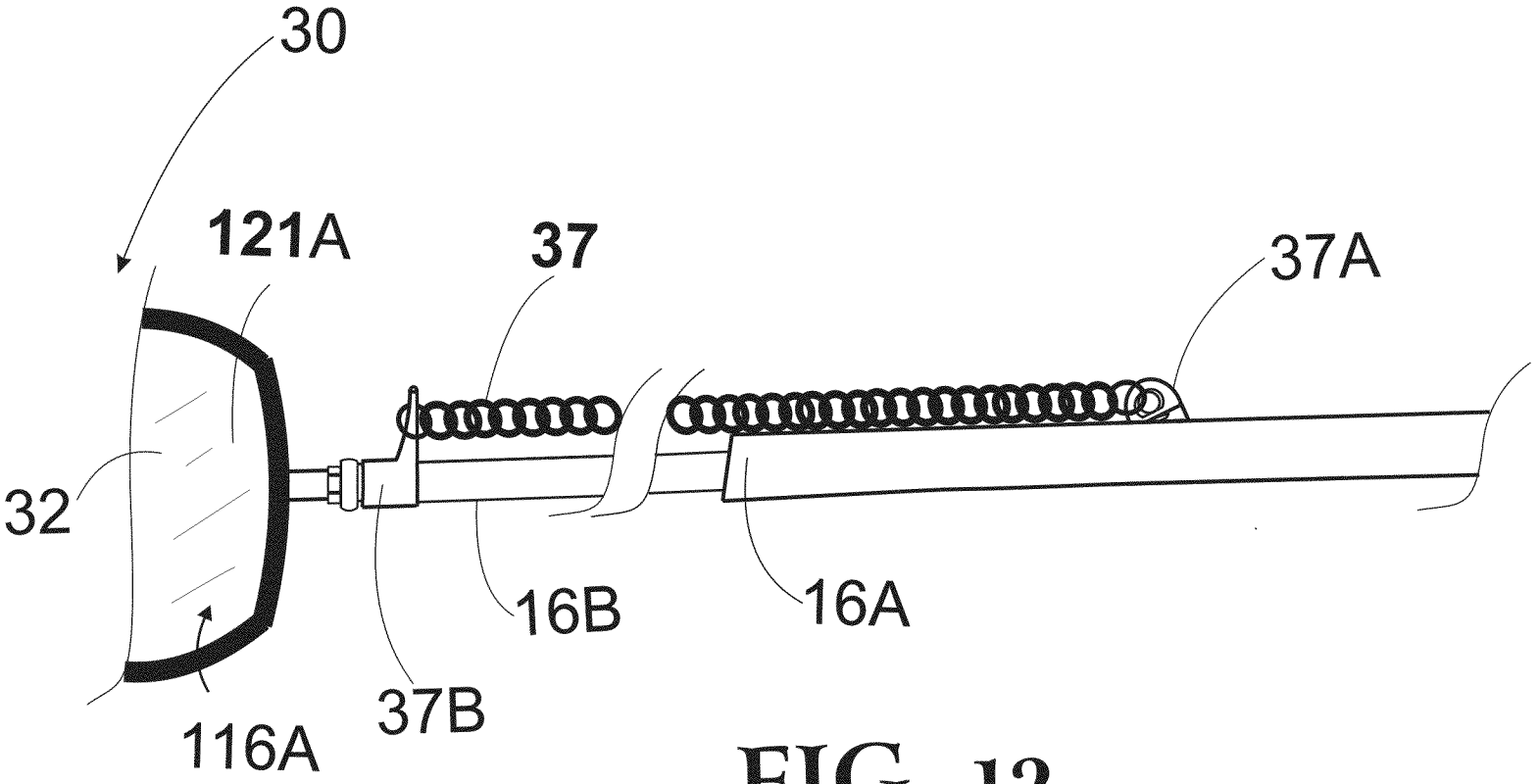
FIG. 12 is a partial and fragmentary side view of the inner enclosure surfacing with a portion of an embodiment of a preferred embodiment of the attached headpiece subassembly shown, along with a portion of the outer enclosure surfacing of the boom subassembly of the present invention.

As positionally set forth in FIG. 11, the leg sensing subassembly 180 is positioned behind the practicing Golfer (2), so that the Golfer's foremost or forward leg (in the case of the right-handed Golfer, the left leg) is positioned against the first extension leg contact member 182. The boom subassembly 16 is positioned for use in front of the practicing golfer so that the head guiding subassembly 30 is withdrawn from the front of the face from lateral portions of the head of the Golfer (2), as illustrated by example in FIG. 11.

The solenoid or pivot switch means 18S is then activated with energy or power and the trigger-rocker arm 18A is moved and withdrawn away from the stop member 16S and from inside the end portion of the inside surfacing 16B of the boom subassembly 16, and the biasing force exerted by the biasing means or member 37 between the outside surfacing 16A and the inside surfacing forces the inside surfacing 16B to pivot in backward linear fashion, thus pulling and moving the head guiding subassembly 30 away from lateral portions of the golfer's (2) head as the golfer follows through with their golf swing and shot.

Additionally, the trigger rocker arm 18A is biased so that when the inner surfacing 16B of the boom 16 is brought back down, or in a linearly backward positioning, to reset and position the head guiding assembly 30, the stop member 16S comes to stop and be engaged, again, and held within the channel 16H by the front end or trigger portion of the trigger rocker arm 18A for another golf shot.

Thus, the boom's inner surfacing 16B and its connected head subassembly 30, are available for head-positioning for the next shot, and the rocker-arm 18A extends again into that channel of the outer surfacing to grasp and hold the stop member 16S and the inner surfacing 16B of the boom assembly for the next golf shot. As indicated, members and elements of this embodiment, and the invention as a whole, can be made and fabricated from a number of materials including, for example, but not limited to, various types of metals, pvc-tubing in various sizes, weights and diameters and various other types of plastics or polymers, or plastic wood and/or metal combinations.

Therefore, In a preferred embodiment of the invention, a generally vertically positioned (through three-dimensional means) boom subassembly (16) is provided with an outer enclosure or surfacing (16A) which has a pivotally movable and installed inner enclosure or surfacing (16B). The inner enclosure (16B) and the outer enclosure (16A) are connected by a biasing means or subassembly (37) which places or exerts biasing pressure to pull the inner enclosure (16B), containing the head subassembly (30), backward towards the further end (away from the Golfer's head) of the outer enclosure (16A). The outer enclosure (16A) has channeling (16H) on and in its end portion; preferably, in about the end third portion of the outer enclosure (16A) of its end positioned, when operating (thus, most further from the Golfer and head subassembly (30)), as illustrated by example. The channeling (16), itself, has an elongated beginning segment or portion (16H-1) and end segment or portion (16H-2). The inner enclosure (16B) is provided with the trigger mount or stop element (16S) at its backward end for movement inside and along the channeling (16H); and the flexible and adjustable head subassembly (30) is positioned and fixedly or pivotably attached at its forward end, which is spaced from its backward end, as illustrated by example.

As indicated, the biasing means (37) interacting with the outer and inner enclosures is installed to pull the inner enclosure so that the stop element of the inner enclosure is moved to the end of the channeling (16H-2). A mount/trigger subassembly or means (18) for setting and releasing the inner enclosure in relation to the channeling (16H) is installed on the outer enclosure in functioning positional relation to the channeling (16H) and is provided with the trigger element or trigger-rocker arm (18A) which registers with the channeling (16H) and receives and secures the trigger mount or stop element (16S) of the inner enclosure (16B) when it is brought to a set or triggered position. The trigger (18A) is connected to an off-on actuator (18S); and the actuator (18S) communicates in terms of energy or power provision with the leg sensing subassembly (180), which is supplied by the energy or power means (175P) when it's switch is positioned in the closed or circuit connecting-position. The first extension (182) is connected to the switch (183); and the second extension (184) is connected to the switch (185). Each of the switches (183 and 185) is a biased and pivotable switch which automatically pivots or moves to the open position (or closed current position), in terms of the circuit connecting to the power source (175P) and the mount/trigger subassembly or means 18, after it is moved to the closed or closed circuit position by movement of the respective extension (182 or 184), when engaged. In this regard, it will be understood within the concepts and spirit of the invention that a number of power, energy or electrical witches may be employed to provide this function in the present invention (10); and that a remote control or wireless energy or signal communicating device can also be employed to provide power from energy or power through each of the respective switches (183 or 185) to the solenoid or pivot switch means (18S) to move the trigger-rocker arm or trigger (18A) to disengage from the stop member (16S) to release the biased inner surfacing (16B) to move backward, withdrawing and moving the head guiding subassembly (30) from the Golfer's (2) head.

Thus, for example, when the right-handed Golfer (2), shown by example in FIG. 11, is using the invention (10) and strikes the golf ball (1), that person characteristically advances their left leg, thigh or knee some distance forward, This is the leg most close to the direction of the ball the Golfer is aiming at. Accordingly, when the left leg presses against the extension leg contact (182) of the subassembly (180), this causes the switch (183) to move to an on-position where power is supplied to the off-on actuator or solenoid or pivot switch means (18S), causing it to pivot the trigger-rocker arm (18A) and release it from the stop element (16S) which causes the biased inner enclosure (16B) to pivot and move within the outer enclosure (16A), drawing the head assembly away from lateral portions of the Golfer's (2) head where the boom has been positioned prior to striking the golf ball.

In preferred embodiments the switch or switches (183 or 185 and/or 183 and 185) as used in the device and system of the present invention (10), depending on the use of the invention by a right-handed and/or left-handed Golfer or Golfers, are the various types of momentary switches or biasable spring loaded switches which generally close a parallel circuit for a short period of time so that a signal can be issued or a circuit connected, in this case, which provides power or energy from the power source or means, or energy or power means, 175P to the solenoid or pivot switch means 18S, so that the trigger-rocker arm or trigger 18A can be lifted or disengaged from the stop-member or stop point means 16S connected to the pivotable or slideable inside guide member, enclosure or surfacing 16B; which, then, allows the head guiding subassembly 30 connected to the inside guide member 16B to be withdrawn from the lateral portions of the Golfer's head.

In preferred embodiments, each of the switches (183 and 185), is provided, for example, as the "Napa Echlin Momentary Switch push button STB-6301" (see, for example, at: http://www.ebay.ie/itm/Napa-Echlin-Momentary-Switch-push-button-STB-6301-/131473980461?hash=item1e9c75bc2d). This type of switch is often used as a starter switch in a vehicle or motorized unit; but, in this case is utilized as a means for providing a quick connection for providing power or energy to the mount/trigger subassembly or means, solenoid or like means 18 before it automatically goes to the off or non-circuit engaging position through its spring or biasing mechanism. However, within the scope and spirit of the invention a number of switches having the spring or biasable button or push-member can be utilized, or an equivalent analog, digital, or momentary or short signal relay means; which can, for a brief time, close a circuit or other equivalent means for providing power or energy from or in relation to the power source or means, or energy or power means, 175P. The Napa Echlin Momentary Switch described by example has been found to provide enough spring, pivot or movement when it automatically closes itself off from the circuit, after the first extension leg contact member 182, or the second extension leg contact member 184, has been engaged and depressed and the golf ball has been hit; that it is not necessary to provide a spring-loaded extension member (182 and/or 184) to return to its starting position before the golf ball is hit again or the device is used again, as the force from the switch (183 and/or 185), itself, is sufficient to move the respective extension member (182 and/or 184) back into starting or loaded position. However, within the scope and spirit of the present device and system 10, when other types or equivalent switches (183 and/or 185) are utilized in the construction thereof, the respective extension members (182 and/or 184) can be provided as spring loaded or otherwise biased extension members (not shown) for use in the invention with such types of switches being utilized so that these extension members will return to their respective starting position after the golf ball has been hit, and as described herein.

In a preferred example of the invention illustrated by the referenced exemplar drawings thereof, where wiring is used; in preferred embodiments, it is preferred to use a 16 gauge wiring. However, it will be understood within the scope and spirit of the invention that other acceptable gauges or other means of wiring can be utilized. Thus, in these regards, the electrical wiring 21, in a preferred embodiment, leading from the mount/trigger subassembly (18) and placing the mount/trigger subassembly or means (18) on parallel or equivalent circuit with the switch or switches (183 and/or 185) and the power means (175P); is illustrated by example in FIGS. 3 through 9. The electrical wiring 175A placing the power source or means (175P) on parallel circuit or equivalent circuit with the switch or switches (183 and/or 185) and the mount/trigger subassembly or means (18); is illustrated by example in FIGS. 10A and 10C.

The electrical wiring 175B, in a preferred embodiment, placing the switch (183) on parallel or equivalent circuit with the power means (175P) and the mount/trigger subassembly or means (18); is illustrated by example in FIGS. 10A and 10C.

The electrical wiring 175C, in a preferred embodiment, placing the switch (185) on parallel or equivalent circuit with the power means (175P) and the mount/trigger subassembly or means (18); is illustrated by example in FIGS. 10B and 10C.

Figure 13:
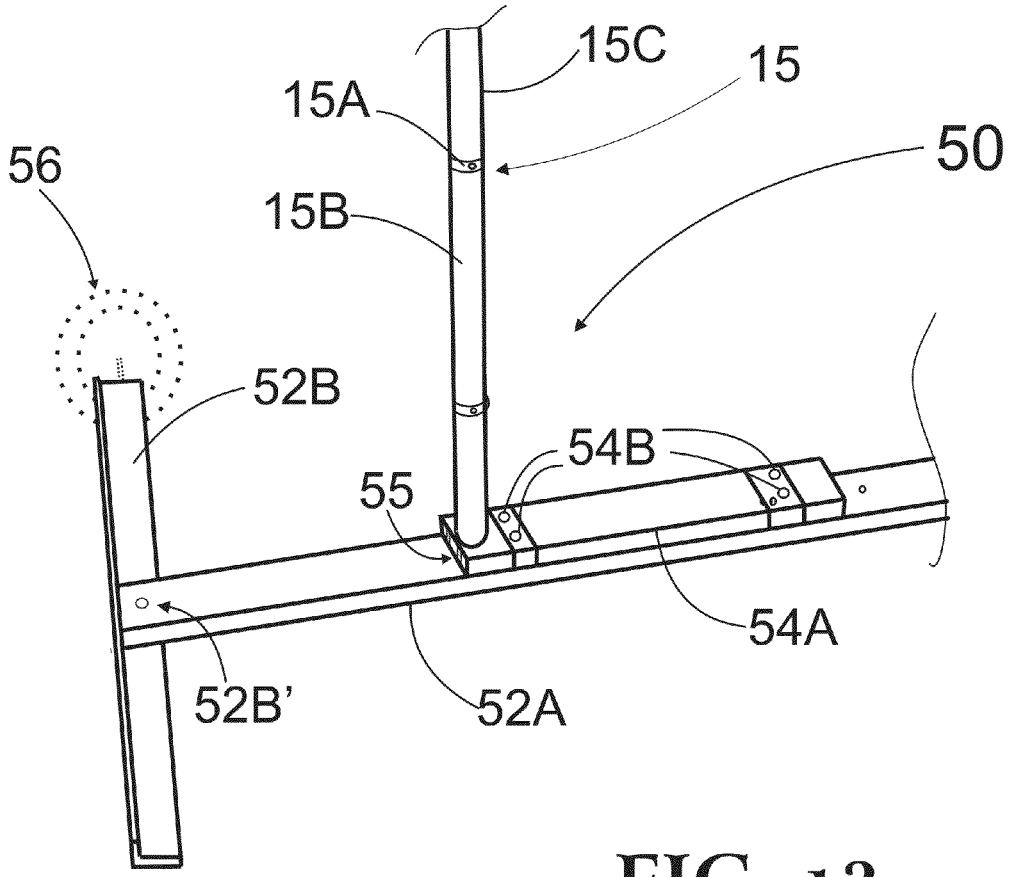
FIG. 13 is an elevated side perspective view of a portion of another preferred embodiment of the base subassembly of the present invention.

As shown in FIG. 13, another preferred embodiment of the Golf Device and system of the invention 10 is provided with a cross base subassembly 50 having a longitudinal and elongated base member 52A and a crossing base member 52B. Preferred embodiments of the subassembly 50 provide the crossing base member 52B with a pivotable attaching member 52B', attaching the base members 52A and 52B so that the crossing member 52B can be pivoted in relation to the elongated base member 52A when needed. This allows and facilitates the cross base subassembly 50 so that the device can be more easily stored, moved or transported, when the crossing member 52B is pivoted or moved generally to the axis of the elongated base member 52A. The base 50 is preferably constructed or fabricated with a plastic, polymer, wood and composites thereof, or a light metal which is durable and strong, and which is provided at a low mass or overall weight, for ease of movement, shipping and transportation. It will be understood that a diverse number of fabricating materials can be used for this purpose. For example, in a preferred embodiments wood or wood composites, plastic or polymer tubing, and such elongated members, as illustrated by example, are preferably used for this purpose. Further, each of the base members 52A and 52B can be fabricated in multiple sliding parts for ease of storage, positioning and transportation. However, in this embodiment it is preferred that each of the base members 52A and 52B be of one-piece construction, and attached to one another as shown by example in FIG. 13 where the crossing base 52B is securely attached to the elongated base 52A in a basically perpendicular positional orientation; and such, as indicated earlier, that it can be pivoted to a different angle if needed by release or adjustment of the pivotable attaching member 52B'. This embodiment of the Golf Device 10 utilizes the vertical upright boom support member 15, described herein, which is attached to the elongated base member 52A and extends upward or spaced from the base 52A in a substantially perpendicular or diagonal spatial orientation. In preferred embodiments the boom support 15 is provided in a rigid position on the elongated base 52A which can be positioned and securely attached as desired with respect to the vertical positioning of the support member 54A. The pivotable and movable hinge member 55 can be provided which allows the vertical support 15 to be moved downwardly in a position on or proximate to the elongated base 52A for transportation yet permits the vertical member to be extended upward in a locked position when the device 10 is used.

The vertical boom support 15 is attached to the collar support 54A, having its adjustment member or members 54B, providing releasable and movable support to the vertical support 15. Thus, the collar support 54A can be slideably and adjustably moved and securely positioned, for adjustable positioning as shown by example in FIG. 13; or which can also be non-movably secured to the base member 52A as an upper platform piece for rigid installment.

This embodiment is further provided with the securement collar 15A, as in the other preferred embodiment discussed herein, for being position ally adjusted to secure the position of the extension member 15C of the vertical support 15, by virtue of the holding pressure it provides, of the extension member 15C, already described herein.

In a further related, preferred embodiment to that just discussed directly above, either end of the crossing base 52B is provided with adjustable wheels and axels 56, as shown by example on one end of the crossing base 52B in FIG. 13.

It will be understood within the spirit and scope of the present invention that the wiring, activation and power for operation of the solenoid 18S in the triggering subassembly 18 or equivalent electrical means can be wired, supplied or activated by a number of diverse arrays of electrical wiring, electrical or other wireless impulse or mechanical means such that the triggering subassembly 18 is activated and made the subject of movement of the trigger rocker arm 18A or equivalent activating triggering means to engage and activate movement or engagement of the inner guide member 16B, and as further discussed herein.

The forward portion 16F of the boom subassembly 16, as illustrated by example in FIG. 9 and other drawing illustrations, is provided with the slideable juxtaposition of the ends of the inside guide surfacing 16B and the outside support surfacing 16A. In preferred embodiments, the inside surfacing 16B is dimensioned to have a length in relation to the outside support surfacing 16A, to function as described herein, and is also dimensioned to extend a spaced distance away from the outside support 16A, and the front portion thereof 16F so that most practicing, golfing persons can fit comfortably in relation to the boom subassembly 16 when the inside guide member 16B is extended away from the outside support member 16A. As indicated, In this regard, the inside guide member 16B is provided with the head guiding subassembly 30.

The head guiding subassembly 30 is provided with lateral head position placements 32; as shown by example in FIGS. 2, 3, 5, 9, 9A, 10A, and 11. The head subassembly 30 is also provided, in preferred embodiments of the invention, with head position hinge members 34 for flexible or pivotable positioning and securement of the head position placements 32, in the use of the head subassembly 30 to be adjusted to rest on lateral or side portions of a person's head area for guidance while making the golf practice shot, as discussed more completely herein. Also a part of the head subassembly 30 is the padded members 36, as illustrated by example in FIGS. 8B and 10A, and others. The head subassembly 30 is attached to the inside guide member 16B through a threadable coupling between the two pieces, but can also be so connected by other means in a rigid fixed position and in a pivotable, rotational or biasably torqued ore movable manner such that adjustments can be made to more accurately position the head subassembly 30 in relation to the lateral portions of the head of a practicing Golfer (2). In such an arrangement, as illustrated by example at FIG. 5, a nut and threaded bolt setup is utilized where the nut portion 121A is connected to the frontal end 116A of the inside guide member 16B and the threaded portion 121B is provided by the connection portion or end of the head subassembly 30; so that the head subassembly 30 is connected to the inside guide member 16B. In this manner, it will be appreciated that different head subassemblies can be attached to the guide member 16B and utilized for specific or special purposes. The buffer member 121C is preferably installed on the front end of the inside guide member (16B); as illustrated by example in FIG. 10A, and other drawings. The buffer 121C can be constructed from a number of preferably flexible or semi- or partially-flexible materials; but can be constructed of hard materials as well. The buffer 121C helps to absorb or buffer the outside support member 16A when the inside guide member 16B comes to rest upon or proximate to the outside support member 16A.

Within the scope and spirit of the present invention (10) a number of means for attachment of the two parts may be employed within the scope and view of the present invention, and that a number of different head subassemblies can be used. However, it is preferred to use the present construction to achieve light guiding and adjustable pressure against a practicing golfer's head while allowing for some movement of the head, while the head position placements 32 are adjustable themselves to the size of the golfer's head for comfortable fit and guidance, until the Golfer (2) actually strikes the golf ball; which, as further described herein, causes an activating force to pull the head subassembly 30 back and away from the golfer's head. This allows the golfer to naturally follow through with their golf club after hitting the golf ball.

As discussed herein, in a preferred embodiment the securement collar 15A, as illustrated by example in FIGS. 9, 9B and 13 can be adjusted and secured to a desired location on the extension member 15C by virtue of tightening the securement means or member 15A-N on the collar 15A, at the location or position selected along the extension member 15C.

It will also be understood within the scope and spirit of the present invention that attachment of parts or elements of the invention throughout the inventions parts can be securely or rigidly secured (such as through welding or other more permanent attachments), or positionally, pivotally or adjustably attached and secured in many ways and manners to meet the stated purposes, functions and objectives of the present invention.

Additional preferred embodiments of the present invention also include within the scope and spirit of the invention the system, method or process of the present invention 10. The system includes the use of the invention illustrated by example, and described herein, in relation to FIGS. 1 through 12; in a method or process which includes:

A system or method of use of the device of claim 3; where the system comprises:

engaging the movable trigger with the trigger rocker arm such that the head subassembly is in cocked or loaded position;

positioning the head subassembly in relation to the lateral sides of the head of a practicing Golfer so that the head is guided to focus downward at a golf ball to be hit in a practicing golf shot;

positioning the leg sensing subassembly so that at least a portion of the foremost leg of a practicing Golfer is flush or resting against the leg sensing subassembly; and taking and completing a practice golf shot by a golfer, so that contemporaneous with striking a golf ball the foremost leg of a Golfer advances forward engaging the leg sensing subassembly, the leg sensing subassembly upon said engaging closing a witch allowing energy from a source of power to energize and move the solenoid switch causing the rocker arm to pivot releasing the moveable trigger so that the head subassembly is pulled back and away from the lateral portions of the head of a Golfer as the Golfer follows through in hitting a practicing golf shot.

Additional aspects of preferred embodiments of the present system 10 of the invention also include:

providing the boom subassembly (16) having a biasably interacting inner surfacing (16A) and outer surfacing 16B, and supporting the means of mount/trigger subassembly (18) on the outer surfacing (16A) and the head guiding subassembly (30) on the inside surfacing (16B), where the mount/trigger (18) engages and disengages the inner surfacing so that the inner surfacing with the head subassembly (18) can be set in position in positional relation to the head of the Golfer (2), and biasably disengaged and removed from the head of the Golfer (2).

In addition, further elements and aspects of preferred embodiments of the present system 10 also include:

(a) providing a means for coordinating the activation of the mount/trigger subassembly (18) to release the inner surfacing (16B) when the Golfer (2) strikes the Golf Ball (1) to pull the head subassembly (18) away from the head of a Golfer (2), where the means consists of the leg sensing subassembly (180) having at least one switch and leg extension in activatable communication with the power or energy source (175P);

(b) supporting and positioning the boom subassembly (16) so that the head guiding subassembly (30) is positioned in contact with lateral portions of the head of a Golfer (2);

(c) engaging and activating the leg sensing subassembly (180), so that the at least one leg extension moves the switch to activate and communicate energy or power from the source (175P) to the mount/trigger subassembly (18) to release the biased inner surfacing to move backwards, thus withdrawing the head subassembly from the head of the Golfer (2), as the Golfer hits the golf ball (1) and follows through with their golf shot; and (d) re-setting and positioning the boom subassembly (16) by re-setting and re-engaging the mount/trigger subassembly in relation to the biasable inner surfacing so that the Golfer can take another practicing golf shot.

Figure 14:
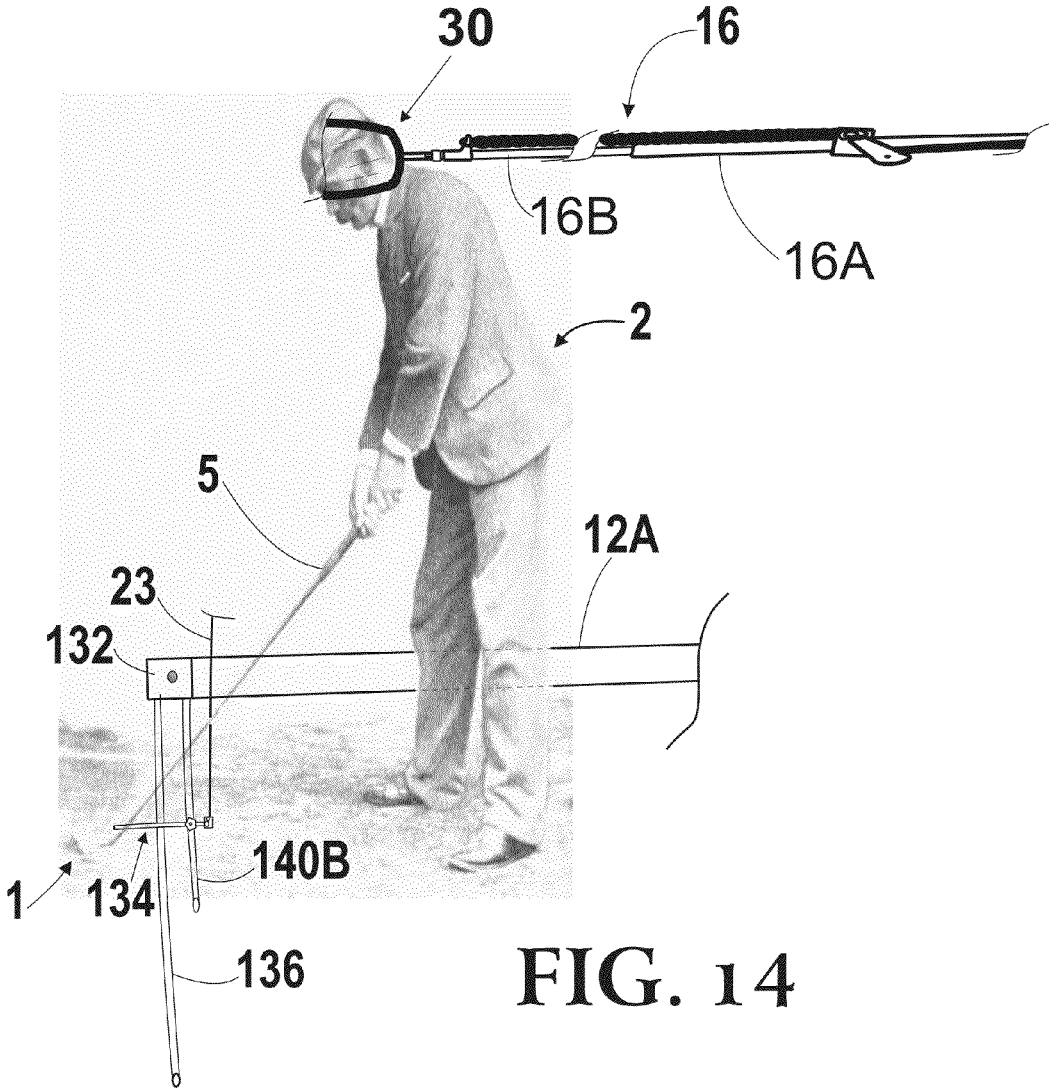
FIG. 14 is a frontal view of a partial portion of the boom subassembly of another embodiment of the invention, and an embodiment of a golf club extension and switch subassembly of the present invention, showing an illustrative view of a right-handed golfer.

In another preferred embodiment, the golfing device 10 is further provided with the golf club sensing subassembly 130, as illustrated by example in FIG. 14. The sensing subassembly 130 is provided with a forked member 132, in preferred embodiments. The sensing switch unit 134 and the protective, cushioning and flexible tubing member 136 are, respectively, supported by and attached to, respective fork portion 138A or further respective fork portion 138B of the forked member 132, depending upon whether the practicing golfer is left-handed or right-handed. The protective, cushioning and flexible tubing member 136 is utilized as a golf club guide and protection means for helping to guide the golf club as the golfer is swinging it to hit the golf ball, and as a protective shield means to protect the switch unit 134 from potential or possible damage from a swinging golf club.

As illustrated in this embodiment, illustrated by example in FIG. 14, the forked member 132 of the club sensing subassembly 130 is attached to the elongated base member 12A by the adjustable bolt member 139; and by virtue of this the forked member can be pivoted to a corresponding opposite position to accommodate a left-handed or right-handed practicing golfer. For example, the setup for accommodating a right-handed golfer is shown by example in FIG. 14; and the setup for accommodating a left-handed golfer is shown by example in FIG. 13. In so doing, when the practicing golfer is in position to utilize the golfing device 10 and hit a golf ball placed near the forked member 132, the club sensing subassembly 130 will always be closest and most proximate to the golfer as this person stands an prepares to hit the golf ball, while the flexible tubing member 136 will be further away from the golfer and closed or most proximate to the golf ball which has been placed on the ground to be hit while utilizing the present invention 10.

In the embodiment of the invention, illustrated example in FIG. 14, the sensing switch unit 134 is provided with the arm member 140; which, in preferred embodiments, is structured to be adjustable and extendable to accommodate for distance preferences by practicing golfers. In this regard, the arm 140 is provided with the adjustable sub-member 140A which is fabricated with a bolt attachment such that the at least part of the arm 140 is positionable or movable as desired before being secured into rigid position. At one of its ends the arm member 140 is provided with, or has attached to it, the golf club contact tubing 140B. And at the other of its ends the arm 140 extends and is attached to the pivot connection member 142A of the switch unit base 142. The switch unit base 142 also supports as attached the push-button switch member 142B. The switch unit base 142; and thus the sensing switch unit 134, can be moved along the respective fork portion 138A to a desired position and then secured thereat for functional use, as illustrated in FIG. 14.

As indicated, members and elements of this embodiment, and the invention as a whole, can be made and fabricated from a number of materials including, for example, but not limited to, various types of metals, pvc-tubing in various sizes, weights and diameters and various other types of plastics or polymers, or plastic wood and/or metal combinations.

Thus, while preferred embodiments of the present golfing device invention 10 have been described and illustrated it will be appreciated by those skilled in the art that various changes can be made regarding the present invention without departing from the scope and spirit of this invention.

I claim:

1. A golf swing improvement device having a boom assembly, supported by means for vertical support; a base assembly, the means for vertical support being attached to and secured by the base assembly for support thereof, and a swinging golf club sensing assembly connected to or proximate to but separate and spaced from the base assembly; the device further comprising:

the boom assembly having an inside guide member and an outside support member, the inside guide member being slideable in relation to the outside support member and having frontal and backward ends, the frontal end of the inside guide member having an adjustable head assembly, attached thereto, having lateral portions for fitting around the side or lateral portions of the head of a practicing golfer using the device;

means for providing a biasing force between the inside guide member and the outside support member so as to draw the inside guide member to the outside support member when extended therefrom and released, said means being connected and attached to the outside support member;

the outside support member having means for triggering the activation of the means for providing a biasing force such that the inside guide member is moved to the outside support member;

the swinging golf club sensing assembly having an arm member for transferring a activating force or signal to the means for triggering the activation of the means for providing a biasing force; and means for relatching and setting for triggering the inside guide member in relation to the outside support member for reuse.

2. A golf swing improvement device having a boom subassembly, the boom subassembly being supported by a base subassembly having means for providing vertical support in relation to an installation ground or floor surface, for three-dimensional support and positioning relative to the lateral portions of a Golfer's head when the Golfer is preparing to make a practice golf shot, and a swinging golf club and leg-sensing subassembly being responsive to a golfers foremost leg movement when the golfer is taking a practicing shot, structurally and functionally having means for three-dimensional positionability, and being connected to, but positionally proximate, separate and spaced from, the base subassembly when in functional use; the leg-sensing subassembly having a means for activating a power source when leg movement is sensed to provide energy to the boom subassembly for movement thereof; the device further comprising:

the boom subassembly having first and second ends; and proximate to the second end defining a trigger reception channel, extending a spaced distance toward the first end; the channel having mounted within it a moveable trigger; and, proximal to the channel, having means for holding and releasing the moveable trigger; and the second end having a extendable and retractable head piece subassembly, the head piece communicating with the moveable trigger when the device is prepared for use.

3. The device of claim 2, wherein, the base subassembly comprising a plurality of interconnecting structural parts extending along a relative x, y, and z-axis in positional relation to the installation ground or floor surface upon which a Golfer is practicing in hitting golf balls.

4. The device of claim 3, wherein the structural parts having a cross-sectional configuration selected from a group consisting of circular, elliptical, square, rectangular, diamond, and other arcuate and planar configurations.

5. The device of claim 3, wherein, the structural parts comprising:

a construction having a lower section having at least a middle component and side components on either side of the middle component, wherein each component is constructed from at least one locking member.

6. The device of claim 5, wherein, at least one of the components are internally reinforced with at least one internal base support member.

7. The device of claim 5, wherein, the structural parts are of pvc-tubing construction.

8. The device of claim 5, wherein, the structural parts of the base subassembly further comprising a vertical support member having first and second ends, being releasably telescoped in construction, and having at least two sub-support members being slideable, positionable and positionally fixable in relation to one another; one of said ends being positionably, fixedly and releasably connected to the boom subassembly.

9. The device of claim 3, wherein, the means for holding and releasing the trigger, comprising:

a pivotable switch member, having a trigger holding member which is positionally engageable and releasable with and in relation to the moveable trigger.

10. The device of claim 9, wherein, the pivotable switch member comprises a solenoidal switch member, the switch member being connected to and energized and engaged by the swinging golf club and leg-sensing subassembly.

11. The device of claim 10, wherein, the solenoidal switch member further comprises a solenoid base support member upon which it is mounted and supported; the solenoidal switch member having a connection member which extends to and engages the trigger holding member; said trigger holding member being pivotably mounted on the solenoid base support member, and positionally available for engaging and holding the moveable trigger member when it is moved to engage the trigger holding member.

12. The device of claim 11, wherein, the boom subassembly further comprises, a inner slideable member and an outside surfacing member, the solenoid base support member being mounted on the outside surfacing member, and the moveable trigger being mounted on the inner slideable member such that it moves within, and extends from, the channel for engagement by the trigger holding member.

13. The device of claim 12, wherein, the head piece subassembly is mounted on the inner slideable member, and comprises at least two spaced and adjustable lateral side members for positioning the lateral portions of a Golfer's head.

14. The device of claim 13, wherein, the inner slideable member and the outside surfacing member having a means for pulling them toward one another.

15. The device of claim 9, wherein, the swinging golf club and leg-sensing subassembly comprising a leg sensing base support (188) comprising a plurality of interconnecting structural parts extending along a relative x, y, and z-axis in positional relation to the installation ground or floor surface upon which a Golfer is practicing in hitting golf balls.

16. The device of claim 15, wherein, the structural part extending along the z-axis comprises a positionable vertical extension (189).

17. The device of claim 16, wherein, the leg-sensing subassembly further comprising:

a mounting adjustment support bar (186);

a extension support prong (190);

the mounting adjustment support bar (186) being releasably and positionably, but securely, attached to the extension support prong (190); said extension prong (190) being coupled to the vertical extension (189) of the leg sensing base support (188);

at least one means for briefly or momentarily switching a power or energy source on circuit, such that power or energy can be provided through wiring or equivalent communication to the means for holding and releasing the trigger (183 or 185), said means for switching (183 or 185) being positionably and securely connected to the mounting adjustment support bar (186);

at least one extension leg contact member (182 or 184), being attached to the at least one means for switching (183 or 185) for depressing and engaging said at least one means for switching when the at least one extension leg contact member is engaged through contact with a portion of the foremost leg of a practicing Golfer when the Golfer is hitting a golf ball, for switching a power or energy source on circuit.

18. The device of claim 17, wherein, the extension support prong (190) further comprising:

a clamp member portion (192), the clamp member portion (192) being attached to the mounting adjustment support bar (186);

a clamp position base (193), a section of the clamp member portion (192) being securably housed in the clamp position base (193), said clamp position base (193) having means (193A, 193B) of securing the clamp member portion (192); and a securement collar portion (194), the collar portion (194) having means for securement of the collar portion (194) to the vertical extension (189).

19. The device of claim 15, wherein, the swinging golf club and leg-sensing subassembly further comprising a means for three-dimensionally extending a leg extension switch for engagement of a golfer's foremost leg and upon contact therewith activating a power source for conveyance of energy to the pivotable switch member for movement thereof; the means being mounted on the vertical extension (189).

20. A system or method for use of the device of claim 3; the method comprising:

engaging the movable trigger with the trigger rocker arm such that the head subassembly is in cocked or loaded position;

positioning the head subassembly in relation to the lateral sides of the head of a practicing Golfer such that the head is guided to focus downward at a golf ball to be hit;

positioning the leg sensing subassembly such that at least a portion of the foremost leg of a practicing Golfer is flush or resting against the leg sensing subassembly; and taking and completing a practice golf shot by a golfer, such that contemporaneous with striking a golf ball the foremost leg of a Golfer advances forward engaging the leg sensing subassembly, the leg sensing subassembly upon said engaging closing a switch allowing energy from a source of power to energize and move the solenoid switch causing the rocker arm to pivot releasing the moveable trigger such that the head subassembly is pulled back and away from the lateral portions of the head of a Golfer as the Golfer follows through in hitting a practicing golf shot.

21. A golf swing improvement device having a boom assembly, supported by means for vertical support; a base assembly, the means for vertical support being attached to and secured by the base assembly for support thereof, and a swinging golf club sensing assembly connected to or proximate to, but separate and spaced from, the base assembly; the device further comprising:

the boom assembly having an inside guide member and an outside support member, the inside guide member being slideable in relation to the outside support member and having frontal and backward ends, the frontal end of the inside guide member having an adjustable head assembly, attached thereto, with lateral portions for fitting around the side portions of the head of a practicing golfer using the device;

means for providing a biasing force between the inside guide member and the outside support member so as to draw the inside guide member to the outside support member when extended therefrom and released, said means being connected and attached to the outside support member;

the outside support member having means for triggering the activation of the means for providing a biasing force such that the inside guide member is moved to the outside support member;

the swinging golf club sensing assembly having an arm member for transferring a activating force or signal to the means for triggering the activation of the means for providing a biasing force; and means for relatching and setting for triggering the inside guide member in relation to the outside support member for reuse.

* * * * *